US011345980B2

(12) United States Patent
Gable et al.

(10) Patent No.: US 11,345,980 B2
(45) Date of Patent: May 31, 2022

(54) RECYCLED ALUMINUM ALLOYS FROM MANUFACTURING SCRAP WITH COSMETIC APPEAL

(71) Applicant: Apple Inc., Cupertino, CA (US)

(72) Inventors: Brian M. Gable, San Jose, CA (US); Herng-Jeng Jou, San Jose, CA (US); Weiming Huang, State College, PA (US); Graeme W. Paul, Mountain House, CA (US); William A. Counts, Sunnyvale, CA (US); Eric W. Hamann, Santa Clara, CA (US); Katie L. Sassaman, San Jose, CA (US); Abhijeet Misra, Sunnyvale, CA (US); Zechariah D. Feinberg, San Francisco, CA (US); James A. Yurko, Saratoga, CA (US); Brian P. Demers, Los Gatos, CA (US); Rafael Yu, Cupertino, CA (US); Anuj Datta Roy, San Jose, CA (US); Susannah P. Calvin, San Jose, CA (US)

(73) Assignee: Apple Inc., Cupertino, CA (US)

( * ) Notice: Subject to any disclaimer, the term of this patent is extended or adjusted under 35 U.S.C. 154(b) by 70 days.

(21) Appl. No.: 16/530,830

(22) Filed: Aug. 2, 2019

(65) Prior Publication Data

US 2020/0048744 A1 Feb. 13, 2020

Related U.S. Application Data

(60) Provisional application No. 62/716,606, filed on Aug. 9, 2018.

(51) Int. Cl.
*C22C 21/00* (2006.01)
*C22C 1/02* (2006.01)
*C22F 1/04* (2006.01)

(52) U.S. Cl.
CPC ..... *C22C 21/00* (2013.01); *C22C 1/026* (2013.01); *C22F 1/04* (2013.01)

(58) Field of Classification Search
CPC .. C22F 1/043; C22F 1/047; C22F 1/04; C22C 21/02; C22C 21/06; C22C 21/08; C22C 21/00; C22C 1/026
See application file for complete search history.

(56) References Cited

U.S. PATENT DOCUMENTS

| | | | |
|---|---|---|---|
| 2,706,680 | A | 4/1955 | Criner |
| 4,269,632 | A | 5/1981 | Robertson et al. |
| 5,769,972 | A | 6/1998 | Sun et al. |
| 9,194,029 | B2 | 11/2015 | Takemura |
| 10,208,371 | B2 | 2/2019 | Misra et al. |
| 10,544,493 | B2 | 1/2020 | Misra et al. |
| 10,597,762 | B2 | 3/2020 | Gable et al. |
| 2005/0238528 | A1 | 10/2005 | Lin et al. |
| 2005/0238529 | A1 | 10/2005 | Lin et al. |
| 2006/0169371 | A1 | 8/2006 | Cosse et al. |
| 2006/0289093 | A1 | 12/2006 | Yan et al. |
| 2008/0066833 | A1 | 3/2008 | Lin et al. |
| 2008/0145266 | A1 | 6/2008 | Chen et al. |
| 2008/0173377 | A1 | 6/2008 | Khosla et al. |
| 2008/0299000 | A1 | 12/2008 | Gheorghe et al. |
| 2009/0242087 | A1 | 10/2009 | Morita et al. |
| 2010/0101748 | A1 | 4/2010 | Hata et al. |
| 2012/0111459 | A1 | 5/2012 | Takemura |
| 2013/0199680 | A1 | 8/2013 | Apelian et al. |
| 2013/0213533 | A1 | 8/2013 | Shikama et al. |
| 2013/0284322 | A1 | 10/2013 | Gasqueres et al. |
| 2014/0366997 | A1 | 12/2014 | Kamat et al. |
| 2014/0377128 | A1 | 12/2014 | Parson et al. |
| 2015/0069770 | A1 | 3/2015 | Hashimoto et al. |
| 2015/0069772 | A1 | 3/2015 | Hashimoto et al. |
| 2015/0090373 | A1 | 4/2015 | Gable et al. |
| 2015/0218677 | A1 | 8/2015 | Aruga et al. |
| 2015/0218679 | A1 | 8/2015 | Aruga et al. |
| 2015/0315680 | A1 | 11/2015 | Yan et al. |
| 2015/0354045 | A1 | 12/2015 | Gable et al. |
| 2015/0368772 | A1 | 12/2015 | Jou et al. |
| 2015/0376742 | A1 | 12/2015 | Matsumoto et al. |
| 2016/0186302 | A1 | 6/2016 | Hatta et al. |
| 2017/0022592 | A1 | 1/2017 | Gupta et al. |
| 2018/0163286 | A1 | 6/2018 | Laurin et al. |
| 2018/0274072 | A1 | 9/2018 | Das et al. |
| 2019/0136348 | A1 | 5/2019 | Ebzeeva |
| 2019/0169717 | A1 | 6/2019 | Li et al. |
| 2019/0211432 | A1 | 7/2019 | Misra et al. |
| 2020/0157699 | A1 | 5/2020 | Misra et al. |

(Continued)

FOREIGN PATENT DOCUMENTS

| | | |
|---|---|---|
| CN | 1760389 | 4/2006 |
| CN | 101479397 A | 7/2009 |
| CN | 101695753 A | 4/2010 |

(Continued)

OTHER PUBLICATIONS

P. Spiekermann, "Alloys—a special problem of patent law?" Nonpublished English Translation of Document, Dec. 31, 2002, 20 pages.

Ma et al., "Corrosion behavior of anodized Al—CU—Li alloy: The role of intermetallic particle-introduced film defects," *Corrosion Science*, 158 (2019), 108110, 11 pages.

Booking et al., "Mechanism of adhesion failure of anodised coatings on 7075 aluminum alloy," Transactionf of the Institute of Metal Finishing, 2011, vol. 89, No. 6, pp. 298-302.

Doan et al.; "Effects of Excess Mg and Si on the Isothermal Ageing Behavious in the Al—Mg2Si Alloys"; Materials Transactions; vol. 43; 2002; p. 1371-1380.

(Continued)

*Primary Examiner* — Jessee R Roe
(74) *Attorney, Agent, or Firm* — BakerHostetler

(57) ABSTRACT

The disclosure provides an aluminum alloy may include iron (Fe) of at least 0.10 wt %, silicon (Si) of at least 0.35 wt %, and magnesium (Mg) of at least 0.45 wt %, manganese (Mn) in amount of at least 0.005 wt %, and additional elements, the remaining wt % being Al and incidental impurities.

44 Claims, 23 Drawing Sheets

(56) References Cited

U.S. PATENT DOCUMENTS

| | | | |
|---|---|---|---|
| 2020/0181746 | A1 | 6/2020 | Gable et al. |
| 2020/0239990 | A1 | 7/2020 | Gable et al. |

FOREIGN PATENT DOCUMENTS

| | | | |
|---|---|---|---|
| CN | 101880805 | A | 11/2010 |
| CN | 103205586 | | 7/2013 |
| CN | 104080935 | A | 10/2014 |
| CN | 104762538 | | 7/2015 |
| CN | 105492640 | | 4/2016 |
| CN | 105671384 | | 6/2016 |
| CN | 107299262 | A | 10/2017 |
| CN | 106435298 | B | 5/2018 |
| CN | 108396209 | A | 8/2018 |
| CN | 109207812 | A | 1/2019 |
| CN | 109666824 | A | 4/2019 |
| CN | 109957690 | A | 7/2019 |
| EP | 2141253 | | 1/2010 |
| EP | 2175042 | A1 | 4/2010 |
| EP | 3183373 | B1 | 12/2018 |
| GB | 516766 | | 1/1940 |
| GB | 1154013 | | 6/1969 |
| JP | S59-126762 | A | 7/1984 |
| JP | 60-234955 | | 11/1985 |
| JP | S64-039340 | A | 2/1989 |
| JP | H02-034741 | A | 2/1990 |
| JP | H-03-294445 | | 12/1991 |
| JP | H10-280081 | A | 10/1998 |
| JP | 2000-313930 | A | 11/2000 |
| JP | 2001-140048 | A | 5/2001 |
| JP | 2001-158951 | A | 6/2001 |
| JP | 2004-269989 | A | 9/2004 |
| JP | 2004-529273 | A | 9/2004 |
| JP | 2006-063420 | | 3/2006 |
| JP | 2007-534839 | A | 11/2007 |
| JP | 2008-019483 | | 1/2008 |
| JP | 2008-019483 | A | 1/2008 |
| JP | 2008-542533 | A | 11/2008 |
| JP | 2010-159489 | | 7/2010 |
| JP | 2011-162840 | A | 8/2011 |
| JP | 2012-149335 | A | 8/2012 |
| JP | 2012-246555 | | 12/2012 |
| JP | 2013-007086 | | 1/2013 |
| JP | 2013-023757 | A | 2/2013 |
| JP | 2013-040356 | A | 2/2013 |
| JP | 2013-189706 | A | 9/2013 |
| JP | 2015-140460 | | 8/2015 |
| JP | 6578048 | B1 | 9/2019 |
| JP | 2020-041215 | A | 3/2020 |
| KR | 10-2012-0031247 | | 3/2012 |
| KR | 2016-0065176 | A | 6/2016 |
| KR | 2017-0034443 | A | 3/2017 |
| WO | WO 1998/055663 | A1 | 12/1998 |
| WO | WO 2000/052216 | A1 | 9/2000 |
| WO | WO 02/101102 | | 12/2002 |
| WO | WO 2006/127811 | | 11/2006 |
| WO | WO 2008/123184 | A1 | 10/2008 |
| WO | WO 2009/024601 | | 2/2009 |
| WO | WO 2011/155609 | | 12/2011 |
| WO | WO 2012/080592 | | 6/2012 |
| WO | WO 2016/176766 | A1 | 11/2016 |

OTHER PUBLICATIONS

Takeda et al.; "Stability of metastable phases and microstructures in the ageing process of Al—Mg—Si ternary alloys"; Journal of Material Science; vol. 33; 1998; p. 2385-2390.

Rokhlin et al.; "Joint Effect of Scandium and Zirconium on the Recrystallization of Aluminum Al—Mg2Si Alloys"; Russian Metallurgy; vol. 2015 No. 5; 2015; p. 381-388.

Suzuki et al.; "Effects of excess magnesium of silicon on the two-step aging behavior of Al—Mg2Si alloys"; vol. 29; University of Tokyo; 1978; p. 197-203 (contains English Abstract).

Ikeda et al., "Effects of Scandium and Zirconium Addition on Recrystallization Behavior of Al—Mg—Si Alloy," *Materials Transactions*, vol. 59, No. 4 (2018) pp. 590-597.

ASM Aerospace Specification Metals Inc.; Aluminum 6063; Retrieved from internet Oct. 6, 2020, http://asm.matweb.com/search/SpecificMaterical.asp?bassnum=MA6063T6, Wayback Archive May 20, 2004.

Kundar et al., "Impact toughness of ternary Al—Zn—Mg alloys in as cast and homogenized condition measured in the temperature range 263-673 K," *Bull. Mater. Sci.*, 2000, vol. 23, No. 1, pp. 35-37.

John A. Taylor, "The effect of iron in Al—Si casting alloys," Conference Paper, Oct. 2004, Cooperative Research Centre for Cast Metals Manufacturing (CAST), The University of Queensland, Brisbane, Australia, 11 pages.

K T Kashyap, "Effect of zirconium addition on the recrystallization behaviour of a commercial Al—Cu—Mg alloy," *Bull. Mater. Sci.*, 2001, vol. 24, No. 6, pp. 643-648.

Weiland et al., "The Role of Zirconium Additions in Recrystallization of Aluminum Alloys," *Materials Science Forum*, 2007, vols. 558-559, pp. 383-387.

Adachi et al., "Effect of Zr Addition on Dynamic Recrystallization during Hot Extrusion in Al Alloys," *Materials Transactions*, vol. 46, No. 2 (2005), pp. 211-214.

Shikama et al., "Highly SCC Resistant 7000-series Aluminum Alloy Extrusion," *Kobelco Technology Review* No. 35, Jun. 2017, pp. 65-68.

Yuan et al., "Effect of Zr addition on properties of Al—Mg—Si aluminum alloy used for all aluminum alloy conductor," *Materials and Design* 32 (2011), pp. 4195-4200.

"International Alloys Designations and Chemical Composition Limits for Wrought Aluminum and Wrought Aluminum Alloys," International Alloy Designations and Chemical Composition Limites for Wrought Aluminum and Wrought Aluminum Alloys, XX, XX, Apr. 1, 2006, pp. 1-35.

Turkyilmaz et al.; "Use of tree rings as a bioindicator to observe atmospheric heavy metal deposition"; Environmental Science and Pollution Research; vol. 26; 2019; p. 5122-5130.

Dian et al.; "The Process Technology and the Application in Automotive on Aluminium Alloy Extrusion"; Metal Forming Technology; vol. 22 No. 1; 2004; p. 62-64 (contains English Abstract).

Fubao et al.; "Research Progress of Microalloyed 6XXX Series Aluminum Alloys"; School of Mechanical Engineering; May 2012; p. 384-388 (contains English Abstract).

Zhu et al.; "Investigation of Streaking Defects on Aluminum Extrusions"; Material Science Forum; vols. 561-565; 2007; p. 341-344.

Zhang Qin; "Design and Construction Manual for Building Curtain Wall and Daylighting Roof"; China Construction Industry Press; Oct. 2002; p. 36 (contains English Abstract).

Kuijpers et al.; "The dependence of the β-AlFeSi to α-Al(FeMn)Si transformation kinetics in Al—Mg—Si alloys on the alloying elements"; Materials Science and Engineering A; vol. 394; 2005; p. 9-19.

J.R. Davis; "Aluminum and Aluminum Alloys"; ASM Specialty Handbook; ASM International; © 1993; p. 43.

MatWeb; "6015 Aluminum Composition Spec"; © 1996-2021; retrieved Dec. 6, 2021; 2 pages.

RECYCLED ALUMINUM ALLOYS FROM MANUFACTURING SCRAP WITH COSMETIC APPEAL

PRIORITY

The disclosure claims the benefit under 35 U.S.C. § 119(e) of U.S. Provisional Patent Application No. 62/716,606, entitled "RECYCLED ALUMINUM ALLOYS FROM MANUFACTURING SCRAP WITH COSMETIC APPEAL," filed on Aug. 9, 2018, which is incorporated herein by reference in its entirety.

FIELD

The disclosure is directed to recycled aluminum alloys and processes for recycling aluminum alloy scrap with cosmetic appeal and applications including enclosures for electronic devices.

BACKGROUND

Commercial aluminum alloys, such as the 6063 aluminum (Al) alloys, have been used for fabricating enclosures for electronic devices. Cosmetic appeal is very important for enclosures for electronic devices.

Conventional recycling of manufacturing chip scrap (e.g. 6063 Al) is generally associated with downgraded quality. Sometimes, in order to maintain the quality of the recycled product, conventional recycling of manufacturing chip scrap and may be limited to a particular source and a limited amount of scrap in the recycled material.

There remains a need for developing alloys and processes for recycling manufacturing scrap to improve the cosmetic appeal of the recycled aluminum alloys.

BRIEF SUMMARY

In one aspect, the disclosure provides an aluminum alloy including iron (Fe) in an amount of at least 0.10 wt %, silicon (Si) in an amount of at least 0.35 wt %, magnesium (Mg) in amount of at least 0.45 wt %, manganese (Mn) in amount of 0-0.090 wt %, non-aluminum (Al) elements in an amount not exceeding 3.0 wt %, the remaining wt % being Al and incidental impurities. In some variations, the aluminum alloy includes silicon (Si) in an amount of at least 0.43 wt % and magnesium (Mg) in amount of at least 0.56 wt %.

In another aspect, a recycled 6000 series aluminum alloy may include iron (Fe) from 0.10 to 0.50 wt %, silicon (Si) from 0.35 to 0.80 wt %, and magnesium (Mg) from 0.45 to 0.95 wt %, manganese (Mn) in amount of 0.005-0.090 wt %, the remaining wt % being Al and incidental impurities, wherein the recycled aluminum alloy has the same cosmetic appeal as a virgin Al 6063 alloy. In some variations, the aluminum alloy includes silicon (Si) in an amount from 0.43 wt % to 0.80 wt %.

In a further embodiment, a process is provided for recycling manufacturing scrap. The process may include (a) obtaining a first recycled aluminum alloy from a first source and a second recycled aluminum alloy from a second source; (b) melting the first and second recycled aluminum alloys to form a melted recycled 6000 series aluminum alloy; (c) casting the melted recycled 6000 series aluminum alloy to form a casted alloy; (d) rolling to form a sheet or extruding to form an extrusion; and (e) fabricating the sheet or extrusion to produce a product.

Additional embodiments and features are set forth in part in the description that follows, and will become apparent to those skilled in the art upon examination of the specification or may be learned by the practice of the disclosed subject matter. A further understanding of the nature and advantages of the disclosure may be realized by reference to the remaining portions of the specification and the drawings, which forms a part of this disclosure.

BRIEF DESCRIPTION OF THE DRAWINGS

The description will be more fully understood with reference to the following figures and data graphs, which are presented as various embodiments of the disclosure and should not be construed as a complete recitation of the scope of the disclosure, wherein.

DETAILED DESCRIPTION

The disclosure may be understood by reference to the following detailed description, taken in conjunction with the drawings as described below. It is noted that, for purposes of illustrative clarity, certain elements in various drawings may not be drawn to scale.

Overview

The disclosure provides recycled 6000 series aluminum alloys formed from scrap. The scrap can be collected from manufacturing processes of conventional aluminum alloys (e.g. 6000 series aluminum alloys or 6063 aluminum). The recycled 6000 series aluminum alloys surprisingly can provide the same or similar cosmetic appeal, mechanical properties, and microstructure as the primary aluminum alloys. The recycled 6000 series aluminum alloys can include higher Fe content, higher Mn content, and/or higher Si content than aluminum alloys made from primary aluminum.

Alloys Formed of Manufacturing Scrap

In some variations, the disclosed 6000 series aluminum alloys are designed to be tolerant to include up to 100% recycled 6000 series aluminum, such as casting scrap, extrusion scrap, chip scrap from manufacturing, among others. The disclosed 6000 series aluminum alloys may also be tolerant to other series scraps, such as 1000 series scrap. The disclosed 6000 series aluminum alloys, also referred as recycled 6000 series aluminum alloys, allow a closed-loop of manufacturing scrap that can reduce use of virgin aluminum, and result in significant reduction of emissions and related carbon footprint. Conventional 6000 series Al can include small amounts of Si and Mg, and optionally includes small amounts of Fe, Mn, Cu, Zr, Pb, Cr, Zn, among others.

Figure 1:
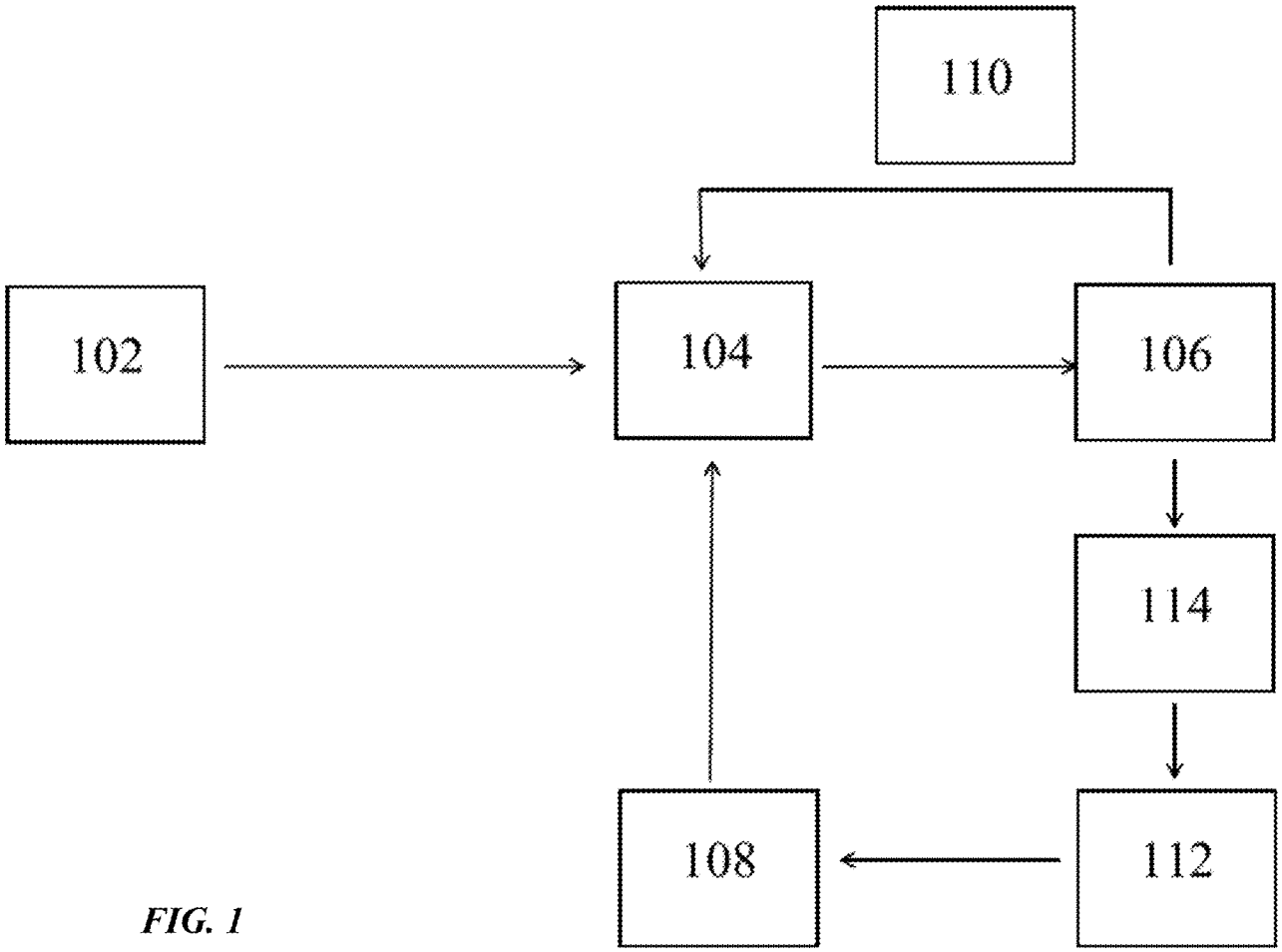
FIG. 1 depicts a recycling process from materials including manufacturing scrap in accordance with embodiments of the disclosure.

FIG. 1 depicts an example of a recycling process from materials including manufacturing scrap in accordance with embodiments of the disclosure. As shown in FIG. 1, a primary aluminum 102 is supplied to material processing 104. Material processing 104 may use recycled materials that incorporates scrap from module manufacturing 106, to build chips. Then, module manufacturing 106 uses the chips fabricated from material processing 104 to build modules. The module manufacturing 106 may have process fallout 110, which provides scrap to material processing 104. This process can be a closed-loop. The disclosure provides materials and methods for recycling scrap from module manufacturing 106.

A customer 114 uses the modules from the module manufacturing 106 to build product, which may be used in field in operation 112. A recovered material 108 may be produced from the field used product. The recovered material 108 may also be provided to material processing 104.

Recycled aluminum alloys accumulate more iron than is typically present in virgin aluminum alloys. The increase in iron can have a negative effect on the cosmetic appeal of aluminum alloys, particularly by having a more gray color. Iron cannot be removed from aluminum alloys by conventional industrial methods, and once iron is included in the aluminum alloy, the amount of iron in the alloy cannot be reduced. Because of the number of iron-containing contact points in a typical supply chain, the amount of iron is higher in recycled aluminum than in virgin aluminum.

Iron has negative effects on the cosmetic appeal by creating an unattractive gray color. In addition to having a negative effect on cosmetics, iron contributes to the formation of iron-aluminum-silicon particles during processing. The acquisition of Si by the iron-containing particles reduces the amount of Si available for strengthening. As such, more Si is added to the alloys disclosed herein. The presently disclosed alloys have increased silicon and increased iron. Contrary to expectations, various properties of the alloy are consistent or better than alloys with such undesirable amounts of iron.

The disclosed recycled 6000 series aluminum alloys allow use of recycled materials, such as manufacturing scrap from various sources. The disclosed recycled 6000 series aluminum alloys result in significant reduction of the carbon footprint associated with manufacturing.

The alloys can be described by various wt % of elements, as well as specific properties. In all descriptions of the alloys described herein, it will be understood that the wt % balance of alloys is Al and incidental impurities. Impurities can be present, for example, as a byproduct of processing and manufacturing. In various embodiments, an incidental impurity can be no greater than 0.05 wt % of any one additional element (i.e., a single impurity), and no greater than 0.10 wt % total of all additional elements (i.e., total impurities). The impurities can be less than or equal to about 0.1 wt %, alternatively less than or equal about 0.05 wt %, alternatively less than or equal about 0.01 wt %, alternatively less than or equal about 0.001 wt %.

In some variations, the alloy has at least 0.14 wt % Fe. Further, in some variations, the alloy has at least 0.43 wt % Si and at least 0.56 wt % Mg. In still further variations, the alloy can have equal to or less than 0.20 wt % Fe. The alloy can have equal to or less than 0.62 wt % Mg and equal to or less than 0.49 wt % Si.

Fe Content

As described above, the scrap (e.g., chip scrap) includes more Fe than the conventional 6000 series aluminum alloys. The Fe may be from sources including tooling among others. The disclosed 6000 series aluminum alloy is designed to have more Fe than conventional 6000 series aluminum alloys or virgin aluminum alloys currently used for cosmetic consumer electronic products.

Figure 2:
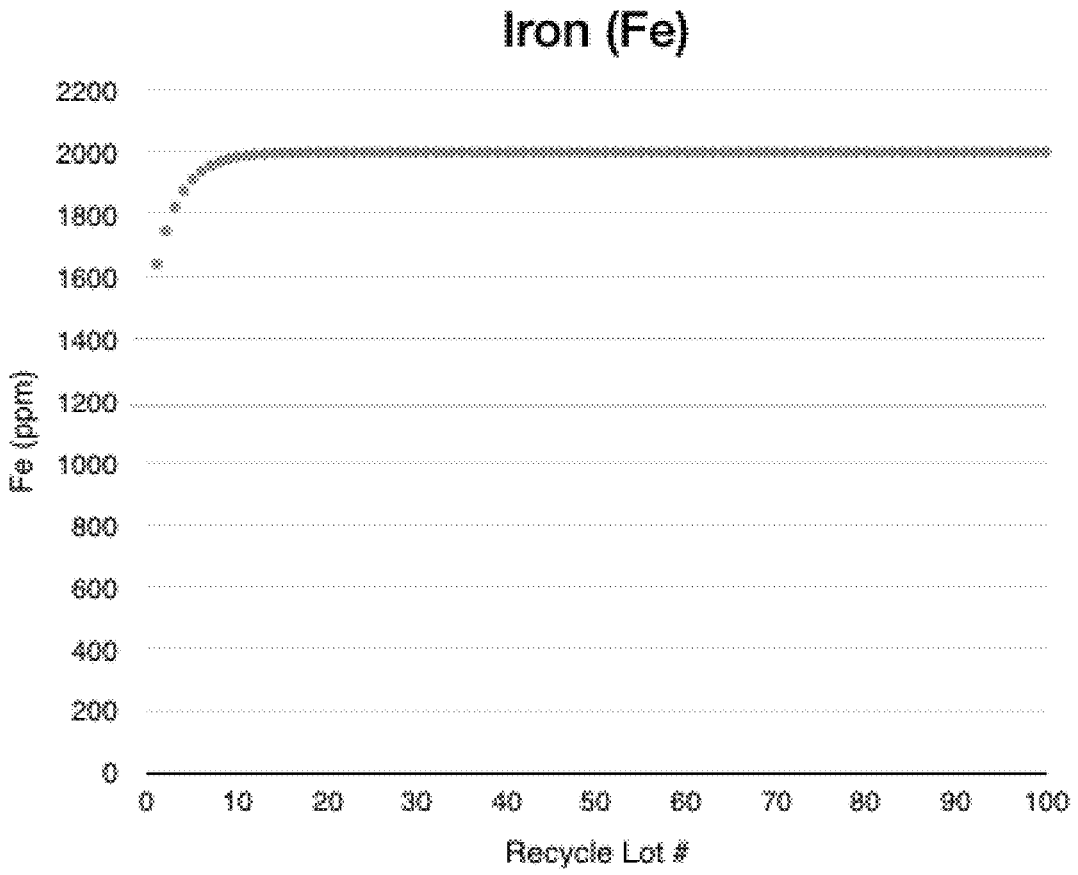
FIG. 2 depicts accumulated iron (Fe) content versus number of times the alloy is recycled in accordance with embodiments of the disclosure.

An accumulation model is used to estimate the Fe content versus the number of times the alloy is recycled, shown in FIG. 2. The recycled aluminum alloys can be recycled multiple times.

FIG. 2 depicts accumulated iron (Fe) content versus number of times the alloy is recycled in accordance with embodiments of the disclosure. As seen in FIG. 2, the Fe content can increase with the number of times the alloy is recycled and then reaches a plateau at about 2000 ppm after about 10 recycles.

In some variations, iron may range from 0.10 wt % to 0.50 wt %.

In some variations, iron may be equal to or greater than 0.10 wt %. In some variations, iron may be equal to or greater than 0.14 wt %. In some variations, iron may be equal to or greater than 0.15 wt %. In some variations, iron may be equal to or greater than 0.16 wt %. In some variations, iron may be equal to or greater than 0.17 wt %. In some variations, iron may be equal to or greater than 0.18 wt %. In some variations, iron may be equal to or greater than 0.19 wt %. In some variations, iron may be equal to or greater than 0.20 wt %. In some variations, iron may be equal to or greater than 0.25 wt %. In some variations, iron may be equal to or greater than 0.30 wt %. In some variations, iron may be equal to or greater than 0.35 wt %. In some variations, iron may be equal to or greater than 0.40 wt %. In some variations, iron may be equal to or greater than 0.45 wt %.

In some variations, iron may be equal to or less than 0.50 wt %. In some variations, iron may be equal to or less than 0.45 wt %. In some variations, iron may be equal to or less than 0.35 wt %. In some variations, iron may be equal to or less than 0.40 wt %. In some variations, iron may be equal to or less than 0.35 wt %. In some variations, iron may be equal to or less than 0.30 wt %. In some variations, iron may be equal to or less than 0.25 wt %. In some variations, iron may be equal to or less than 0.20 wt %. In some variations, iron may be equal to or less than 0.19 wt %. In some variations, iron may be equal to or less than 0.18 wt %. In some variations, iron may be equal to or less than 0.17 wt %. In some variations, iron may be equal to or less than 0.16 wt %. In some variations, iron may be equal to or less than 0.15 wt %.

Ti Content

Scrap can include more Ti than the conventional 6000 series aluminum alloys. The Ti can be added as a grain refiner during casting process. In many instances, the 6000 series aluminum alloy is designed to tolerate more Ti versus conventional aluminum alloys used for similar products.

Figure 3:
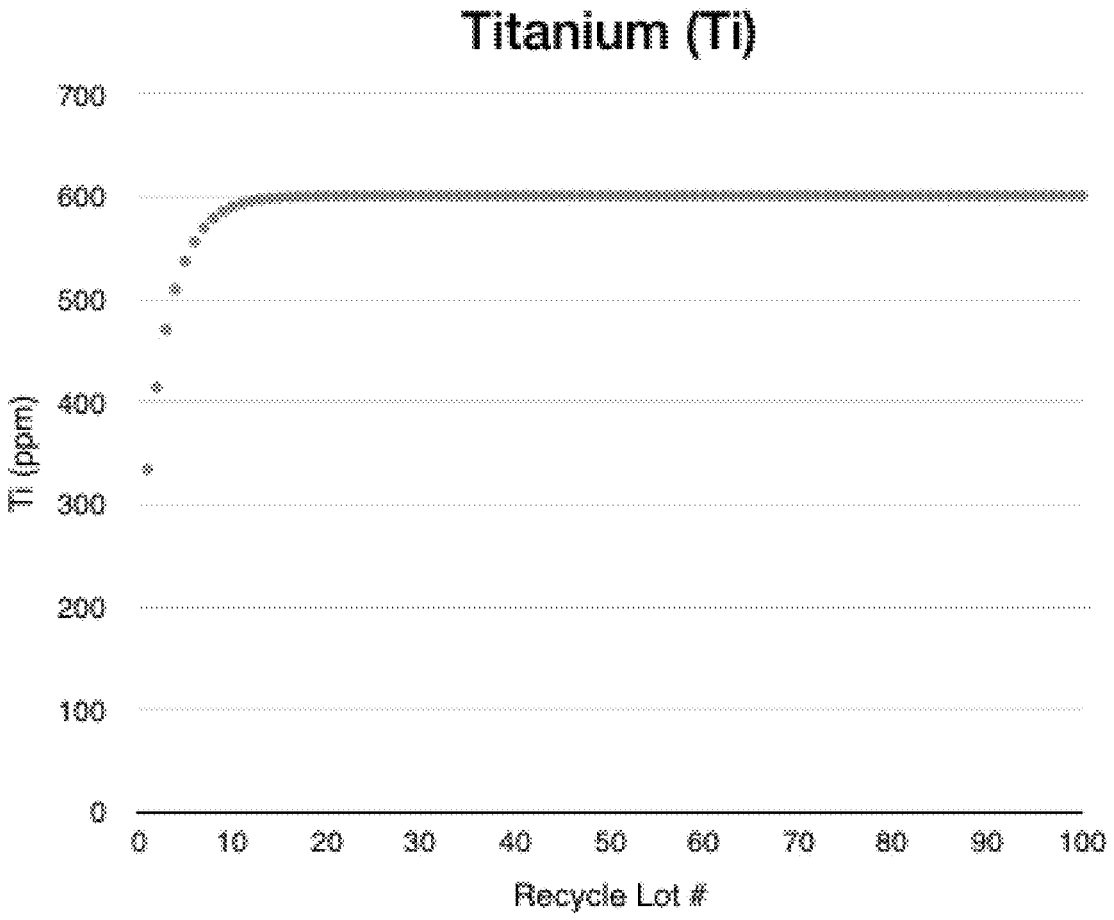
FIG. 3 depicts accumulated titanium (Ti) content versus number of times the alloy is recycled in accordance with embodiments of the disclosure.

An accumulation model is used to estimate the Ti content versus the number of times the alloy is recycled. FIG. 3 depicts accumulated titanium (Ti) content versus number of times the alloy is recycled in accordance with embodiments of the disclosure. As seen in FIG. 3, the Ti content can increase with the number of times the alloy is recycled and then reaches a plateau at about 600 ppm after about 10 recycles.

In some variations, titanium may equal to or less than 0.10 wt %. In some variations, titanium may equal to or less than 0.09 wt %. In some variations, titanium may equal to or less than 0.08 wt %. In some variations, titanium may equal to or less than 0.07 wt %. In some variations, titanium may equal to or less than 0.06 wt %. In some variations, titanium may equal to or less than 0.05 wt %. In some variations, titanium may equal to or less than 0.04 wt %. In some variations, titanium may equal to or less than 0.03 wt %. In some variations, titanium may equal to or less than 0.025 wt %. In some variations, titanium may be equal to or less than 0.020 wt %. In some variations, titanium may be equal to or less than 0.015 wt %. In some variations, titanium may be equal to or less than 0.010 wt %. In some variations, titanium may be equal to or less than 0.005 wt %.

Mn Content, Si Content, Mg Content, and Mg/Si Ratio

Additional Si is added to the disclosed alloy than in a typical cosmetic 6000 series alloy, without a resulting loss of mechanical strength by forming Mg—Si particles.

Without wishing to be limited to any particular theory or mode of action, Mn can be added to break up large contaminant Al—Fe—Si particles and to form smaller Al—Fe—Si—Mn particles.

Figures 4A, 4B, 4C:
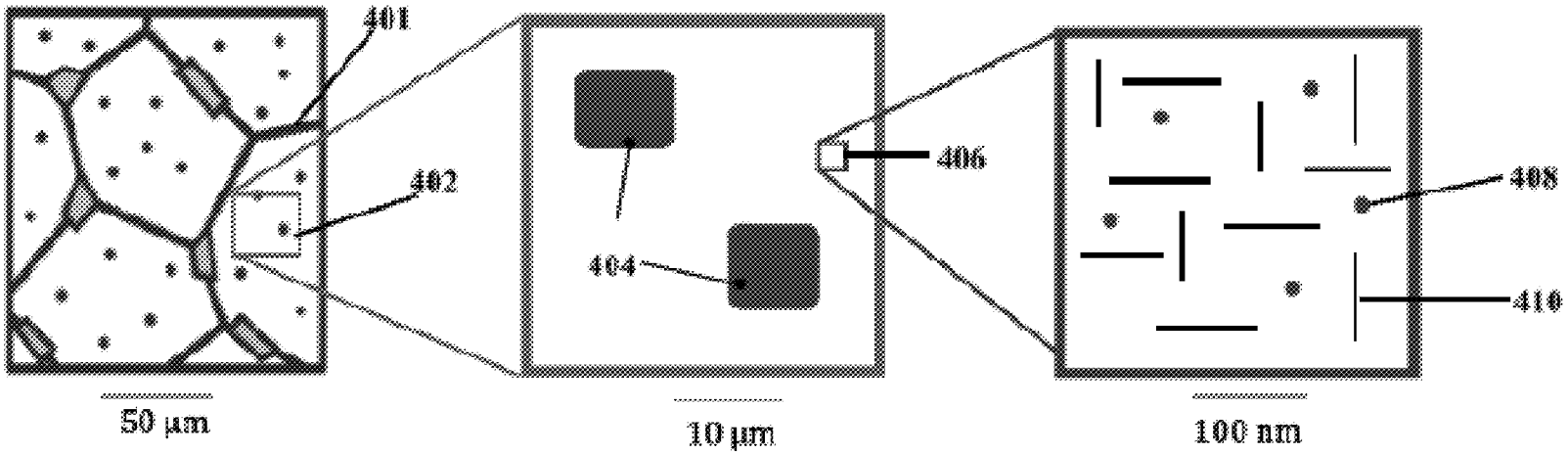
FIG. 4A illustrates a post-heat treatment microstructure of the recycled 6000 series aluminum alloy in accordance with embodiments of the disclosure.
FIG. 4B illustrates constituent phase particles formed before aging in the recycled 6000 series aluminum alloy of FIG. 4A in accordance with embodiments of the disclosure.
FIG. 4C illustrates Mg—Si precipitates formed during aging in accordance with embodiments of the disclosure.

FIG. 4A illustrates a post-heat treatment microstructure of the recycled 6000 series aluminum alloy in accordance with embodiments of the disclosure. FIG. 4B illustrates constituent phase particles formed before aging in the recycled 6000 series aluminum alloy of FIG. 4A in accordance with embodiments of the disclosure. As shown in FIG. 4A, the post-heat treatment microstructure includes region 402 within a grain boundary 401. The grain size within the grain boundary 401 is about 100 μm. The region 402 includes constituent phase Al—Fe—Si particles 404 and a region 406 including constituent phase Mg—Si particles 408 and 410 after aging, as shown in FIG. 4B. Mg—Si precipitates 408 and 410 are formed within fine grain during aging, as shown in FIG. 4C.

FIG. 4C illustrates Mg—Si precipitates formed during aging in accordance with embodiments of the disclosure.

Figure 4F:
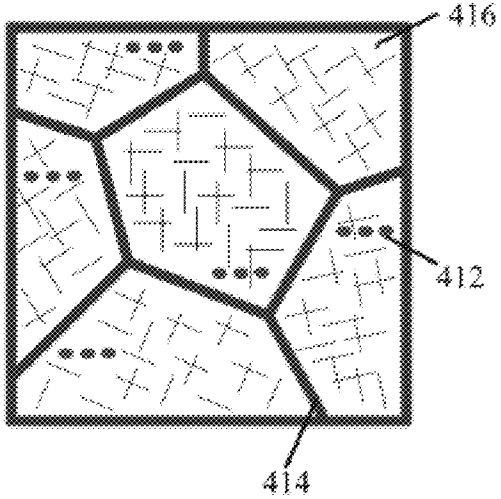
FIG. 4F illustrates contaminant AlFeSiMn particles of a recycled 6000 series aluminum alloy after heat treatment in accordance with embodiments of the disclosure.
Figure 4E:
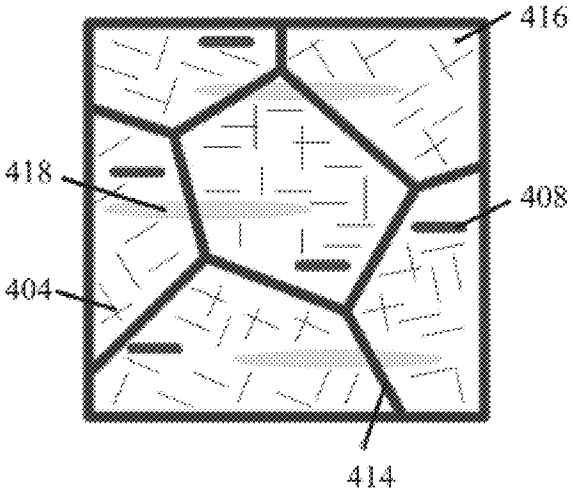
FIG. 4E illustrates contaminant AlFeSi particles after heat treatment in a primary 6000 series aluminum alloy with Fe and Ti contamination in accordance with embodiments of the disclosure.
Figure 4D:
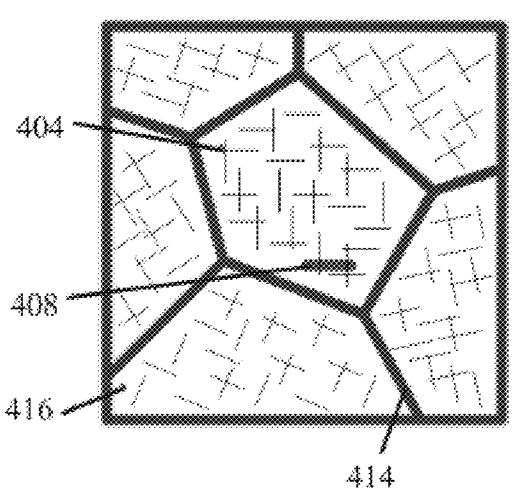
FIG. 4D illustrates contaminant AlFeSi particles after heat treatment in a virgin 6000 series aluminum alloy with Fe contamination in accordance with embodiments of the disclosure.

FIG. 4D illustrates contaminant AlFeSi particles after heat treatment in a virgin 6000 series aluminum alloy with Fe contamination in accordance with embodiments of the disclosure. As shown in FIG. 4D, contamination AlFeSi particles 408 may be present in virgin aluminum alloy and embedded in aluminum 416. For illustration purpose only, one contamination AlFeSi particle 408 is shown within one grain boundary 414. Mg—Si particles 404 are also embedded in aluminum 416.

FIG. 4E illustrates contaminant AlFeSi particles after heat treatment in a primary 6000 series aluminum alloy with Fe and Ti contamination in accordance with embodiments of the disclosure. Iron and titanium contaminations are a consequence of recycling the primary aluminum alloy of FIG. 4D. As shown in FIG. 4E, more contamination AlFeSi particles 408 may be present in the primary aluminum alloy. For illustration purpose only, five contamination AlFeSi particles 408 is shown within in five grain boundaries 414. As shown, fewer Mg—Si particles 404 are present compared to FIG. 4D. The reason for this may be due to the Si previously present in the Mg—Si particles has been used to form particles with iron, such that fewer Mg—Si particles are present. Also, Ti segregations 418 may be present in the recycled aluminum alloy 416.

FIG. 4F illustrates contaminant AlFeSiMn particles of a recycled 6000 series aluminum alloy after heat treatment in accordance with embodiments of the disclosure. The recycled aluminum alloy is formed from the primary aluminum alloy of FIG. 4D. As shown, the addition of Mn to the recycled aluminum alloys help break large AlFeSi particles 408 of the primary aluminum alloy of FIG. 4D into smaller AlFeSiMn particles 412, which helps achieve better cosmetic appeal. The volume fraction of Mg—Si particles 404 is similar to FIG. 4D. The recycled aluminum alloys include higher Mn and higher Si contents than the primary aluminum alloy.

In some variations, silicon may vary from 0.35 wt % to 0.80 wt %.

In some variations, silicon may be equal to or less than 0.80 wt %. In some variations, silicon may be equal to or less than 0.75 wt %. In some variations, silicon may be equal to or less than 0.70 wt %. In some variations, silicon may be equal to or less than 0.65 wt %. In some variations, silicon may be equal to or less than 0.60 wt %. In some variations, silicon may be equal to or less than 0.55 wt %. In some variations, silicon may be equal to or less than 0.50 wt %. In some variations, silicon may be equal to or less than 0.49 wt %. In some variations, silicon may be equal to or less than 0.48 wt %. In some variations, silicon may be equal to or less than 0.47 wt %. In some variations, silicon may be equal to or less than 0.46 wt %. In some variations, silicon may be equal to or less than 0.45 wt %. In some variations, silicon may be equal to or less than 0.40 wt %. In some variations, silicon may be equal to or less than 0.39 wt %. In some variations, silicon may be equal to or less than 0.38 wt %. In some variations, silicon may be equal to or less than 0.37 wt %. In some variations, silicon may be equal to or less than 0.36 wt %.

In some variations, silicon may be equal to or greater than 0.35 wt %. In some variations, silicon may be equal to or greater than 0.36 wt %. In some variations, silicon may be equal to or greater than 0.37 wt %. In some variations, silicon may be equal to or greater than 0.38 wt %. In some variations, silicon may be equal to or greater than 0.39 wt %. In some variations, silicon may be equal to or greater than 0.40 wt %. In some variations, silicon may be equal to or greater than 0.41 wt %. In some variations, silicon may be equal to or greater than 0.42 wt %. In some variations, silicon may be equal to or greater than 0.43 wt %. In some variations, silicon may be equal to or greater than 0.44 wt %. In some variations, silicon may be equal to or greater than 0.45 wt %. In some variations, silicon may be equal to or greater than 0.46 wt %. In some variations, silicon may be equal to or greater than 0.47 wt %. In some variations, silicon may be equal to or greater than 0.48 wt %. In some variations, silicon may be equal to or greater than 0.49 wt %. In some variations, silicon may be equal to or greater than 0.50 wt %. In some variations, silicon may be equal to or greater than 0.55 wt %. In some variations, silicon may be equal to or greater than 0.60 wt %. In some variations, silicon may be equal to or greater than 0.65 wt %. In some variations, silicon may be equal to or greater than 0.70 wt %. In some variations, silicon may be equal to or greater than 0.75 wt %.

Mg can be designed to have the proper Mg/Si ratio to form Mg—Si precipitates for strengthening purpose. In some variations, the ratio of Mg to Si is typically 2:1, but other variations can be possible.

In some variations, magnesium may vary from 0.45 wt % to 0.95 wt %.

In some variations, magnesium may be equal to or less than 0.95 wt %. In some variations, magnesium may be equal to or less than 0.90 wt %. In some variations, magnesium may be equal to or less than 0.85 wt %. In some variations, magnesium may be equal to or less than 0.80 wt %. In some variations, magnesium may be equal to or less than 0.75 wt %. In some variations, magnesium may be equal to or less than 0.70 wt %. In some variations, magnesium may be equal to or less than 0.65 wt %. In some variations, magnesium may be equal to or less than 0.60 wt %. In some variations, magnesium may be equal to or less than 0.55 wt %. In some variations, magnesium may be equal to or less than 0.50 wt In some variations, magnesium may be equal to or greater than 0.50 wt %. In some variations, magnesium may be equal to or greater than 0.55 wt %. In some variations, magnesium may be equal to or greater than 0.60 wt %. In some variations, magnesium may be equal to or greater than 0.65 wt %. In some variations, magnesium may be equal to or greater than 0.70 wt %. In some variations, magnesium may be equal to or greater than 0.75 wt %. In some variations, magnesium may be equal to or greater than 0.80 wt %. In some variations, magnesium may be equal to or greater than 0.85 wt %. In some variations, magnesium may be equal to or greater than 0.90 wt %.

In some variations, the alloy can include Mn. Without wishing to be held to a particular mechanism, effect, or mode of action, Mn can help break up the coarse Al—Fe—Si particles or AlFeSi particles that form during casting.

In some variations, manganese may be equal to or less than 0.090 wt %. In some variations, manganese may be equal to or less than 0.085 wt %. In some variations, manganese may be equal to or less than 0.080 wt %. In some variations, manganese may be equal to or less than 0.075 wt %. In some variations, manganese may be equal to or less than 0.070 wt %. In some variations, manganese may be equal to or less than 0.065 wt %. In some variations, manganese may be equal to or less than 0.060 wt %. In some variations, manganese may be equal to or less than 0.055 wt %. In some variations, manganese may be equal to or less than 0.050 wt %. In some variations, manganese may be equal to or less than 0.045 wt %. In some variations, manganese may be equal to or less than 0.040 wt %. In some variations, manganese may be equal to or less than 0.035 wt %. In some variations, manganese may be equal to or less than 0.030 wt %. In some variations, manganese may be equal to or less than 0.025 wt %. In some variations, manganese may be equal to or less than 0.020 wt %. In some variations, manganese may be equal to or less than 0.015 wt %. In some variations, manganese may be equal to or less than 0.010 wt %. In some variations, manganese may be equal to or less than 0.005 wt %.

In some variations, manganese may be equal to or greater than 0.005 wt %. In some variations, manganese may be equal to or greater than 0.010 wt %. In some variations, manganese may be equal to or greater than 0.015 wt %. In some variations, manganese may be equal to or greater than 0.020 wt %. In some variations, manganese may be equal to or greater than 0.025 wt %. In some variations, manganese may be equal to or greater than 0.030 wt %. In some variations, manganese may be equal to or greater than 0.035 wt %. In some variations, manganese may be equal to or greater than 0.040 wt %. In some variations, manganese may be equal to or greater than 0.045 wt %. In some variations, manganese may be equal to or greater than 0.050 wt %. In some variations, manganese may be equal to or greater than 0.055 wt %. In some variations, manganese may be equal to or greater than 0.060 wt %. In some variations, manganese may be equal to or greater than 0.065 wt %.

In some variations, manganese may be equal to or greater than 0.070 wt %. In some variations, manganese may be equal to or greater than 0.075 wt %. In some variations, manganese may be equal to or greater than 0.080 wt %. In some variations, manganese may be equal to or greater than 0.085 wt %.

Additional Non-Aluminum Elements

The disclosed 6000 series aluminum alloy may include other elements as disclosed below.

In some variations, the alloy can include Cu. Without wishing to be limited to any particular mechanism, effect, or mode of action, Cu can improve corrosion resistance, and/or Cu can influence color of the anodized alloy.

In some variations, copper may vary from 0.010 wt % to 0.050 wt %.

In some variations, copper may be equal to or less than 0.050 wt %. In some variations, copper may be equal to or less than 0.045 wt %. In some variations, copper may be equal to or less than 0.040 wt %. In some variations, copper may be equal to or less than 0.035 wt %. In some variations, copper may be equal to or less than 0.030 wt %. In some variations, copper may be equal to or less than 0.025 wt %. In some variations, copper may be equal to or less than 0.020 wt %. In some variations, copper may be equal to or less than 0.015 wt %.

In some variations, copper may be equal to or greater than 0.010 wt %. In some variations, copper may be equal to or greater than 0.015 wt %. In some variations, copper may be equal to or greater than 0.020 wt %. In some variations, copper may be equal to or greater than 0.025 wt %. In some variations, copper may be equal to or greater than 0.030 wt %. In some variations, copper may be equal to or greater than 0.035 wt %. In some variations, copper may be equal to or greater than 0.040 wt %. In some variations, copper may be equal to or greater than 0.045 wt %.

In some variations, chromium may be equal to or less than 0.10 wt %. In some variations, chromium may be equal to or less than 0.08 wt %. In some variations, chromium may be equal to or less than 0.06 wt %. In some variations, chromium may be equal to or less than 0.04 wt %. In some variations, chromium may be equal to or less than 0.03 wt %. In some variations, chromium may be equal to or less than 0.02 wt %. In some variations, chromium may be equal to or less than 0.01 wt %. In some variations, chromium may be equal to or less than 0.008 wt %. In some variations, chromium may be equal to or less than 0.006 wt %. In some variations, chromium may be equal to or less than 0.004 wt %. In some variations, chromium may be equal to or less than 0.002 wt %.

In some variations, zinc may be equal to or less than 0.20 wt %. In some variations, zinc may be equal to or less than 0.15 wt %. In some variations, zinc may be equal to or less than 0.10 wt %. In some variations, zinc may be equal to or less than 0.08 wt %. In some variations, zinc may be equal to or less than 0.06 wt %. In some variations, zinc may be equal to or less than 0.04 wt %. In some variations, zinc may be equal to or less than 0.03 wt %. In some variations, zinc may be equal to or less than 0.02 wt %. In some variations, zinc may be equal to or less than 0.01 wt %. In some variations, zinc may be equal to or less than 0.005 wt %. In some variations, zinc may be equal to or less than 0.001 wt %.

In some variations, gallium may be equal to or less than 0.20 wt %. In some variations, gallium may be equal to or less than 0.15 wt %. In some variations, gallium may be equal to or less than 0.10 wt %. In some variations, gallium may be equal to or less than 0.08 wt %. In some variations, gallium may be equal to or less than 0.06 wt %. In some variations, gallium may be equal to or less than 0.04 wt %. In some variations, gallium may be equal to or less than 0.03 wt %. In some variations, gallium may be equal to or less than 0.02 wt %. In some variations, gallium may be equal to or less than 0.015 wt %. In some variations, gallium may be equal to or less than 0.01 wt %. In some variations, gallium may be equal to or less than 0.005 wt %. In some variations, gallium may be equal to or less than 0.001 wt %.

In some variations, tin may be equal to or less than 0.20 wt %. In some variations, tin may be equal to or less than 0.15 wt %. In some variations, tin may be equal to or less than 0.10 wt %. In some variations, tin may be equal to or less than 0.08 wt %. In some variations, tin may be equal to or less than 0.06 wt %. In some variations, tin may be equal to or less than 0.04 wt %. In some variations, tin may be equal to or less than 0.01 wt %. In some variations, tin may be equal to or less than 0.008 wt %. In some variations, tin may be equal to or less than 0.006 wt %. In some variations, tin may be equal to or less than 0.004 wt %. In some variations, tin may be equal to or less than 0.002 wt %.

In some variations, vanadium may be equal to or less than 0.20 wt %. In some variations, vanadium may be equal to or less than 0.15 wt %. In some variations, vanadium may be equal to or less than 0.10 wt %. In some variations, vanadium may be equal to or less than 0.08 wt %. In some variations, vanadium may be equal to or less than 0.06 wt %. In some variations, vanadium may be equal to or less than 0.04 wt %. In some variations, vanadium may be equal to or less than 0.02 wt %. In some variations, vanadium may be equal to or less than 0.01 wt %. In some variations, vanadium may be equal to or less than 0.005 wt %. In some variations, vanadium may be equal to or less than 0.001 wt %.

In some variations, calcium may be equal to or less than 0.001 wt %. In some variations, calcium may be equal to or less than 0.0003 wt %. In some variations, calcium may be equal to or less than 0.0002 wt %. In some variations, calcium may be equal to or less than 0.0001 wt %.

In some variations, sodium may be equal to or less than 0.002 wt %. In some variations, sodium may be equal to or less than 0.0002 wt %. In some variations, sodium may be equal to or less than 0.0001 wt %.

One or more of other elements, including chromium, boron, zirconium, lithium, cadmium, lead, nickel, phosphorous, among others, may be equal to or less than 0.01 wt %. One or more of other elements, including chromium, boron, zirconium, lithium, cadmium, lead, nickel, phosphorous, among others, may be equal to or less than 0.008 wt %. One or more of these other elements may be equal to or less than 0.006 wt %. One or more of these other elements may be equal to or less than 0.004 wt %. One or more of other elements may be equal to or less than 0.002 wt %.

In some variations, a total of other elements may not exceed 0.20 wt %. In some variations, a total of other elements may not exceed 0.10 wt %. In some variations, a total of other elements may not exceed 0.08 wt %. In some variations, a total of other elements may not exceed 0.06 wt %. In some variations, a total of other elements may not exceed 0.04 wt %.

Process for Cleaning and Removing Oxides from Scrap

Scrap can have a large surface area/volume ratio compared to alloys made from virgin material. The large surface area of the scrap can include a substantial quantity of oxides, such as aluminum oxides. Scrap may also include impurities, such as Fe or Ti, among others, compared to conventional 6000 series aluminum alloys, 1000 series alloys, or virgin alloys of the 6000 series aluminum alloys.

The cleaning process may include removing oxides by re-melting scrap and flowing oxides and skim off the oxides. The cleaning process may also include removing organic contaminants by chemical solvent or solution or heating.

The disclosed recycled 6000 series aluminum alloys can be made from up to 100% Al scrap, and can be used to form a part by extrusion and sheet rolling. The disclosed recycled 6000 series aluminum alloys can also include scrap extrusion or sheet material. The disclosed methods can include or exclude primary aluminum or virgin aluminum.

Figure 5:
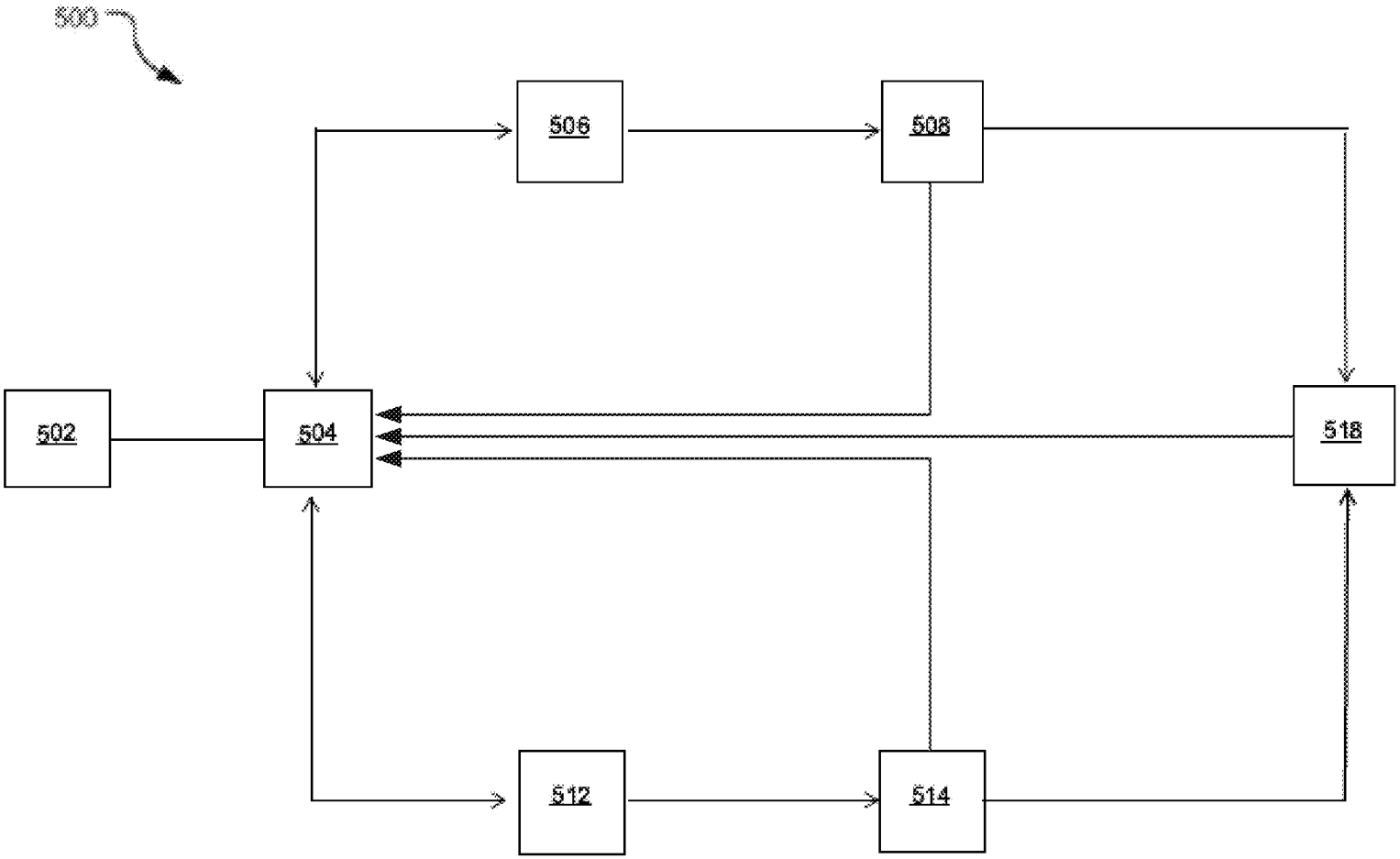
FIG. 5 depicts a recycling process from scrap in accordance with embodiments of the disclosure.

FIG. 5 depicts a recycling process from scrap in accordance with embodiments of the disclosure. As shown in FIG. 5, process 500 includes a source 502 having scrap from two or more sources for aluminum alloys, e.g. source A and source B, which may come from different supply chains.

In some embodiments, a melt for an alloy can be prepared by heating the alloy including the composition. As shown, the scrap is melted at operation 504. After the melt is cooled to room temperature, the alloys may go through various heat treatments, such as casting, homogenization, extruding, sheet rolling, solution heat treatment, and aging, among others.

The melted scrap may be billet cast at operation 506, and then homogenized. In some embodiments, the cast alloys can be homogenized by heating to an elevated temperature and holding at the elevated temperature for a period of time, such as at an elevated temperature of 520 to 620° C. for a period of time, e.g. 8-12 hours.

As shown in FIG. 5, homogenization is used for both extrusion and sheet rolling. Homogenization refers to a process in which the alloy is soaked at an elevated temperature for a period of time. Homogenization can reduce chemical or metallurgical segregation, which may occur as a natural result of solidification in some alloys. Homogenization can also be used to transform long, narrow AlFeSi particles into small, broken up AlFeSi and AlFeSiMn particles. It will be appreciated by those skilled in the art that the heat treatment conditions (e.g. temperature and time) may vary.

The homogenized alloy may be extruded at operation 508. Extrusion is a process for converting a metal billet into lengths of uniform cross section by forcing the metal to flow plastically through a die orifice.

A component of part 518 may be formed from the extruded aluminum alloy obtained at operation 508. Also, a part may be formed from the sheet aluminum alloy obtained at operation 514.

In some embodiments, the extruded alloys can be preheated to an elevated temperature, e.g. about 400° C. and ramped up to a higher temperature, e.g. above 500° C. for extrusion. The extrusion and solution heat-treatment may occur simultaneously at the higher elevated temperature, e.g. about 500° C. The solution heat treatments can alter the strength of the alloy.

The melted scrap from operation 504 may also be slab casted at operation 512, then homogenized, and followed by sheet rolling at operation 514. A component of part 518 may be formed of the rolled sheet from operation 514. As shown, scraps from operations 506, 512, 508, 514, and 518 can be returned to for re-melting at operation 504.

Sheet rolling is a metal forming process in which a metal passes through one or more pairs of rolls to reduce the thickness and to make the thickness uniform. Rolling is classified according to the temperature of the metal rolled. If the temperature of the metal is above its recrystallization temperature, then the process is known as hot rolling. If the temperature of the metal is below its recrystallization temperature, the process is known as cold rolling.

To sheet roll the disclosed 6000 series aluminum alloys, the alloys are first hot rolled at about 250-450° C., and then cold rolled, followed by solution treatment.

In some embodiments, the scrap source 502 may also include a portion of disclosed 6000 series aluminum alloys in addition to the scrap from various sources.

After the solution treatment, the alloy can be aged at a temperature of 125 to 225° C. for about a period of time, e.g. 6-10 hours, and then quenched with water. Referring to FIG. 4C again, aging is a heat treatment at an elevated temperature, and may induce a precipitation reaction to form precipitates Mg—Si. It will be appreciated by those skilled in the art that the heat treatment condition (e.g. temperature and time) may vary.

In further embodiments, the disclosed 6000 series aluminum alloys may be optionally subjected to a stress-relief treatment between the solution heat-treatment and the aging heat-treatment. The stress-relief treatment can include stretching the alloy, compressing the alloy, or combinations thereof.

Cosmetic Appeal

The aluminum alloys disclosed herein typically have more Fe than in conventional aluminum alloys. Aluminum alloys having higher amounts of iron particularly by having a more gray color. The scrap can include more Fe than the conventional 6000 series aluminum alloys. As described above, the recycled aluminum alloys described herein have more iron than that is typically present in virgin aluminum alloys for alloys with cosmetic appeal.

Iron has negative effects on the cosmetic appeal by creating an unattractive gray color. In addition to having a negative effect on cosmetics, iron contributes to the formation of iron-aluminum-silicon particles during processing. The acquisition of Si by the Fe particles reduces the amount of Si available for strengthening. As such, more Si is added to the alloys disclosed herein. The presently disclosed alloys have increased silicon and increased iron. Contrary to expectations, the properties of the alloy are consistent or better than alloys with such undesirable amounts of iron.

In some embodiments, the disclosed 6000 series aluminum alloys can be anodized. Anodizing is a surface treatment process for metal, most commonly used to protect aluminum alloys. Anodizing uses electrolytic passivation to increase the thickness of the natural oxide layer on the surface of metal parts. Anodizing may increase corrosion resistance and wear resistance, and may also provide better adhesion for paint primers and glues than bare metal. Anodized films may also be used for cosmetic effects, for example, it may add interference effects to reflected light.

Surprisingly, the disclosed recycled 6000 series aluminum alloys have the same or improved cosmetic appeal as those with lower iron, silicon, and magnesium. In particular, after anodizing they do not take a yellowish or gray color, and do not have increased cosmetic defects such as mottling, grain lines, black lines, discoloration, white dots, oxidation, and line mark, among others.

In some embodiments, the disclosed 6000 series aluminum alloys can form enclosures for electronic devices. The enclosures may be designed to have a blasted surface finish absent of streaky lines. Blasting is a surface finishing process, for example, smoothing a rough surface or roughening a smooth surface. Blasting may remove surface material by forcibly propelling a stream of abrasive media against a surface under high pressure.

Standard methods may be used for evaluation of cosmetics including color, gloss and haze. The color of objects may be determined by the wavelength of light that is reflected or transmitted without being absorbed, assuming incident light is white light. The visual appearance of objects may vary with light reflection or transmission. Additional appearance attributes may be based on the directional brightness distribution of reflected light or transmitted light, commonly referred to as glossy, shiny, dull, clear, hazy, among others. The quantitative evaluation may be performed based on ASTM Standards on Color & Appearance Measurement or ASTM E-430 Standard Test Methods for Measurement of Gloss of High-Gloss Surfaces, including ASTM D523 (Gloss), ASTM D2457 (Gloss on plastics), ASTM E430 (Gloss on high-gloss surfaces, haze), and ASTM D5767 (DOI), among others. The measurements of gloss, haze, and DOI may be performed by testing equipment, such as Rhopoint IQ.

In some embodiments, color may be quantified by parameters L, a, and b, where L stands for light brightness, a stands for color between red and green, and b stands for color between blue and yellow. For example, high b values suggest an unappealing yellowish color, not a gold yellow color. Nearly zero parameters a and b suggest a neutral color. Low L values suggest dark brightness, while high L value suggests great brightness. For color measurement, testing equipment, such as X-Rite ColorEye XTH, X-Rite Coloreye 7000 may be used. These measurements are according to CIE/ISO standards for illuminants, observers, and the L*, a*, and b* color scale. For example, the standards include: (a) ISO 11664-1:2007(E)/CIE S 014-1/E:2006: Joint ISO/CIE Standard: Colorimetry—Part 1: CIE Standard Colorimetric Observers; (b) ISO 11664-2:2007(E)/CIE S 014-2/E:2006: Joint ISO/CIE Standard: Colorimetry—Part 2: CIE Standard Illuminants for Colorimetry, (c) ISO 11664-3:2012 (E)/CIE S 014-3/E:2011: Joint ISO/CIE Standard: Colorimetry—Part 3: CIE Tristimulus Values; and (d) ISO 11664-4:2008(E)/CIE S 014-4/E:2007: Joint ISO/CIE Standard: Colorimetry—Part 4: CIE 1976 L*, a*, and b* Color Space.

In some variations, L* is from 70 to 100. In some variations, L* is at least 70. In some variations, L* is at least 75. In some variations, L* is at least 80. In some variations, L* is at least 85. In some variations, L* is at least 90. In some variations, L* is at least 95. In some variations, L* is less than or equal to 100. In some variations, L* is less than or equal to 95. In some variations, L* is less than or equal to 90. In some variations, L* is less than or equal to 85. In some variations, L* is less than or equal to 80. In some variations, L* is less than or equal to 75.

In some variations, a* is from −2 to 2. In some variations, a* is at least −2. In some variations, a* is at least −1.5. In some variations, a* is at least −1.0. In some variations, a* is at least −0.5. In some variations, a* is at least 0.0. In some variations, a* is at least 0.5. In some variations, a* is at least −0.5. In some variations, a* is at least 1.0. In some variations, a* is at least 1.5. In some variations, a* is less than or equal to 2.0. In some variations, a* is less than or equal to 1.5. In some variations, a* is less than or equal to 1.0. In some variations, a* is less than or equal to 0.5. In some variations, a* is less than or equal to 0.0. In some variations, a* is less than or equal to 2.0. In some variations, a* is less than or equal to −0.5. In some variations, a* is less than or equal to −1.0. In some variations, a* is less than or equal to −1.5.

In some variations, b* is from −2 to 2. In some variations, b* is at least −2. In some variations, b* is at least −1.5. In some variations, a is at least −1.0. In some variations, b* is at least −0.5. In some variations, b* is at least 0.0. In some variations, b* is at least 0.5. In some variations, b* is at least −0.5. In some variations, b* is at least 1.0. In some variations, b* is at least 1.5. In some variations, b* is less than or equal to 2.0. In some variations, b* is less than or equal to 1.5. In some variations, b* is less than or equal to 1.0. In some variations, b* is less than or equal to 0.5. In some variations, b* is less than or equal to 0.0. In some variations, b* is less than or equal to 2.0. In some variations, b* is less than or equal to −0.5. In some variations, b* is less than or equal to −1.0. In some variations, b* is less than or equal to −1.5.

Mechanical Properties

Yield strengths of the alloys may be determined via ASTM B557, which covers the testing apparatus, test specimens, and testing procedure for tensile testing.

Referring to FIG. 5 again, the 6000 series aluminum alloy can be extruded or rolled with the conventional process for aluminum alloys to have the mechanical properties, including yield strength, tensile strength, elongation, and hardness, to be the same as the aluminum alloy without any scrap.

The mechanical properties have an upper limit, which allows the alloy to be formed with dimensional consistency. The disclosed recycled 6000 series aluminum alloys can exceed the tensile strength and hardness upper limit of other cosmetic aluminum alloys. However, the range of the tensile strength and hardness remains unchanged, i.e. within the range between lower limit and upper limit. The unchanged range allows the dimension consistency during forming process, such as rolling.

Figure 6A:
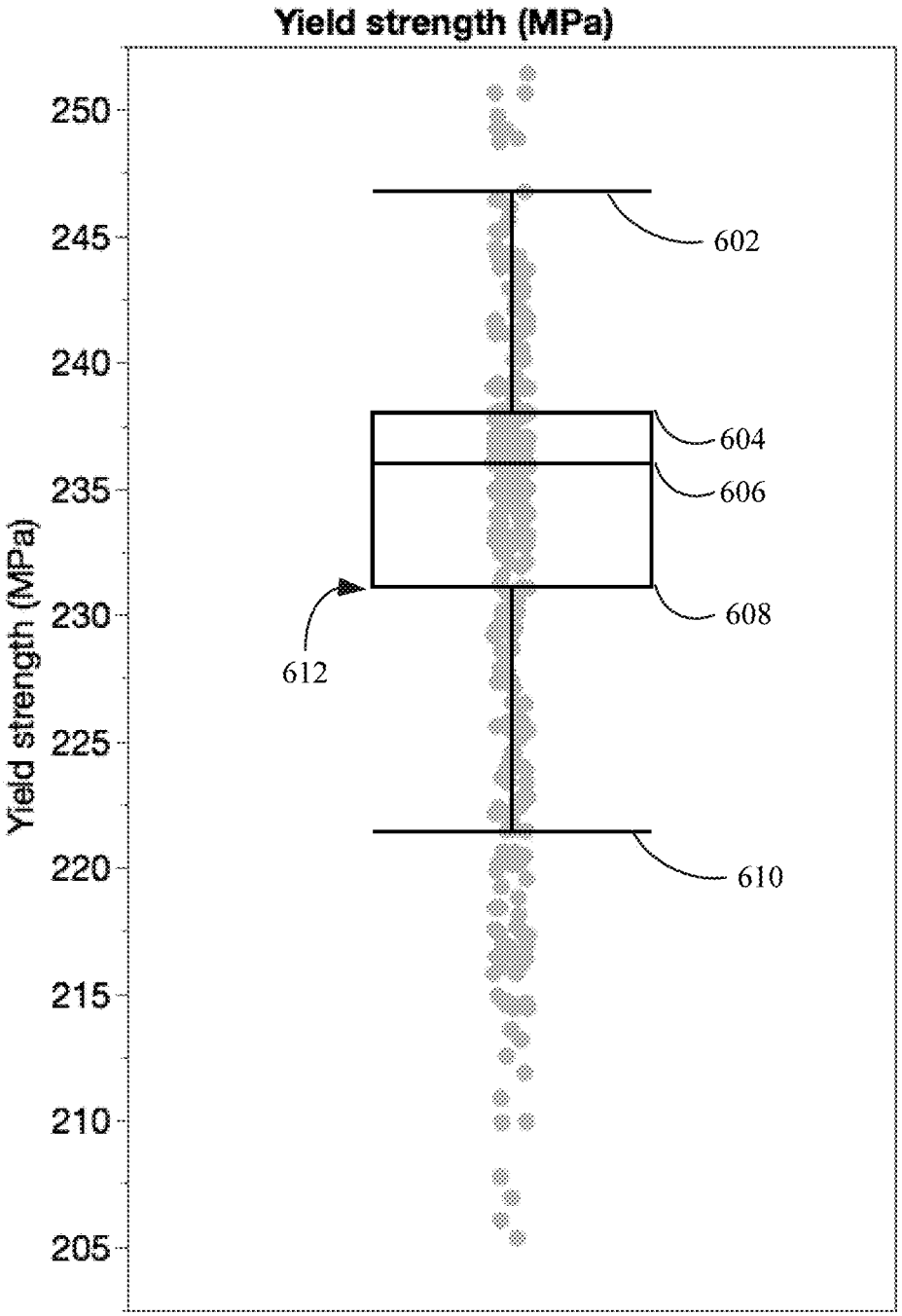
FIG. 6A illustrates the yield strength for extrusion samples formed of an example of the disclosed recycled 6000 series aluminum alloys in accordance with embodiments of the disclosure.

The data corresponding to different preparations were presented in box plots, as shown in FIGS. 6A-6D, 7A-7D, 8A-8E, and 9A-9D. FIG. 6A illustrates the yield strength for extrusion samples formed of an example recycled 6000 series aluminum alloy in accordance with an embodiment of the disclosure.

Figure 6B:
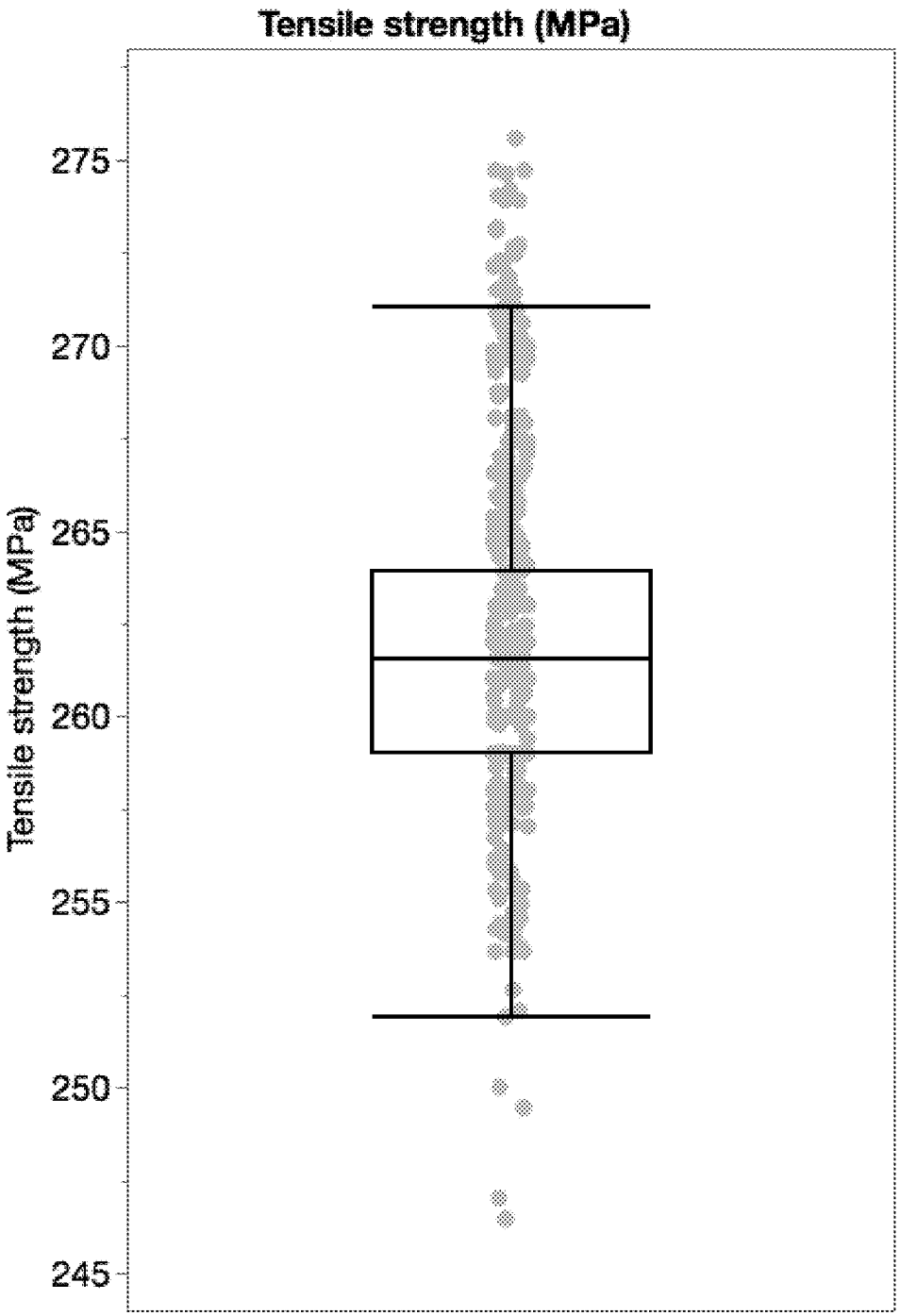
FIG. 6B illustrates the tensile strength for extrusion samples formed of an example of the disclosed recycled 6000 series aluminum alloys in accordance with embodiments of the disclosure.

FIG. 6B illustrates the tensile strength for extrusion samples formed of the recycled 6000 series aluminum alloy, in accordance with an embodiment of the disclosure.

Figure 6C:
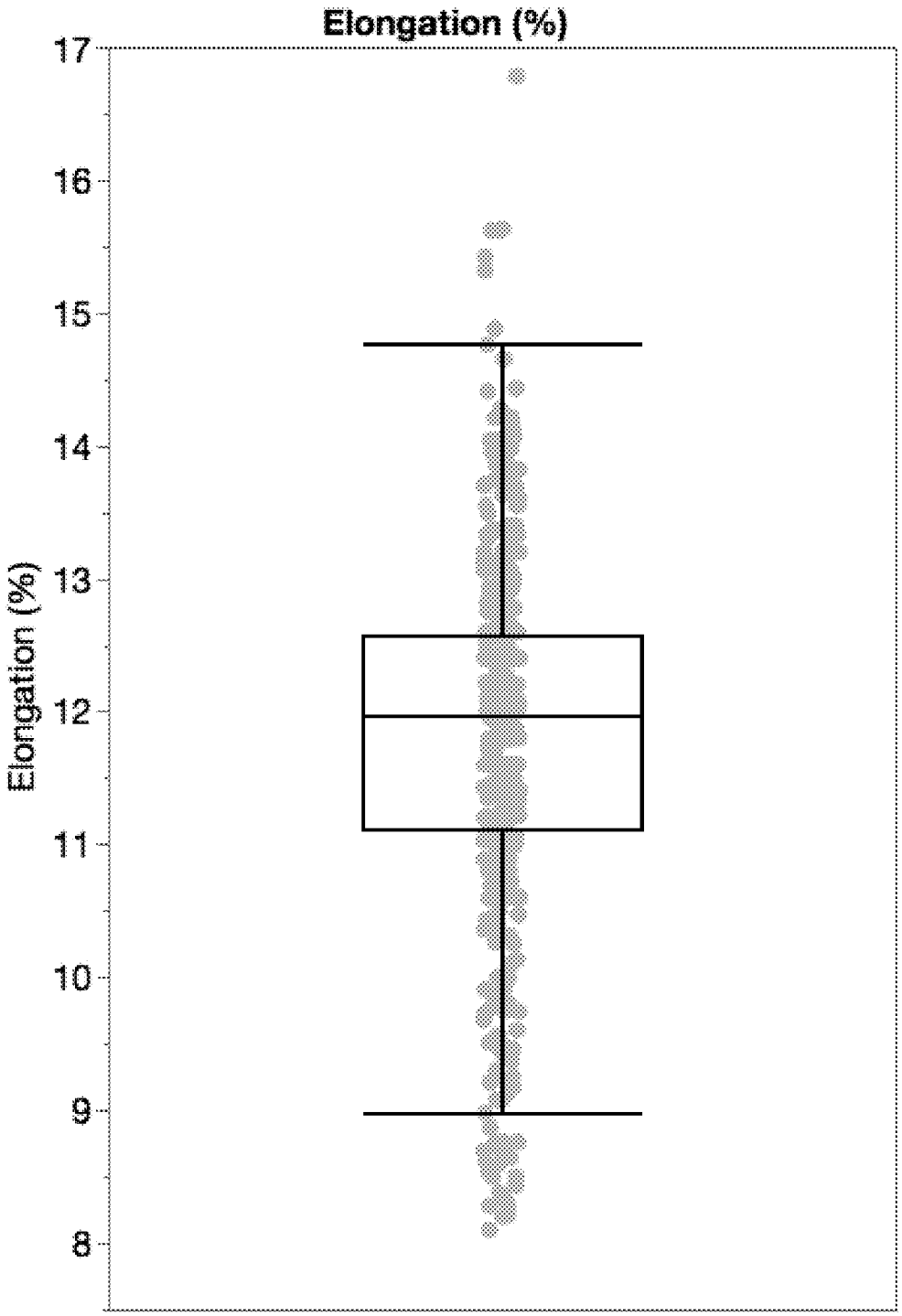
FIG. 6C illustrates the elongation for extrusion samples formed of an example of the disclosed recycled 6000 series aluminum alloys in accordance with embodiments of the disclosure.

FIG. 6C illustrates the elongation for extrusion samples formed of the recycled 6000 series aluminum alloy.

Figure 6D:
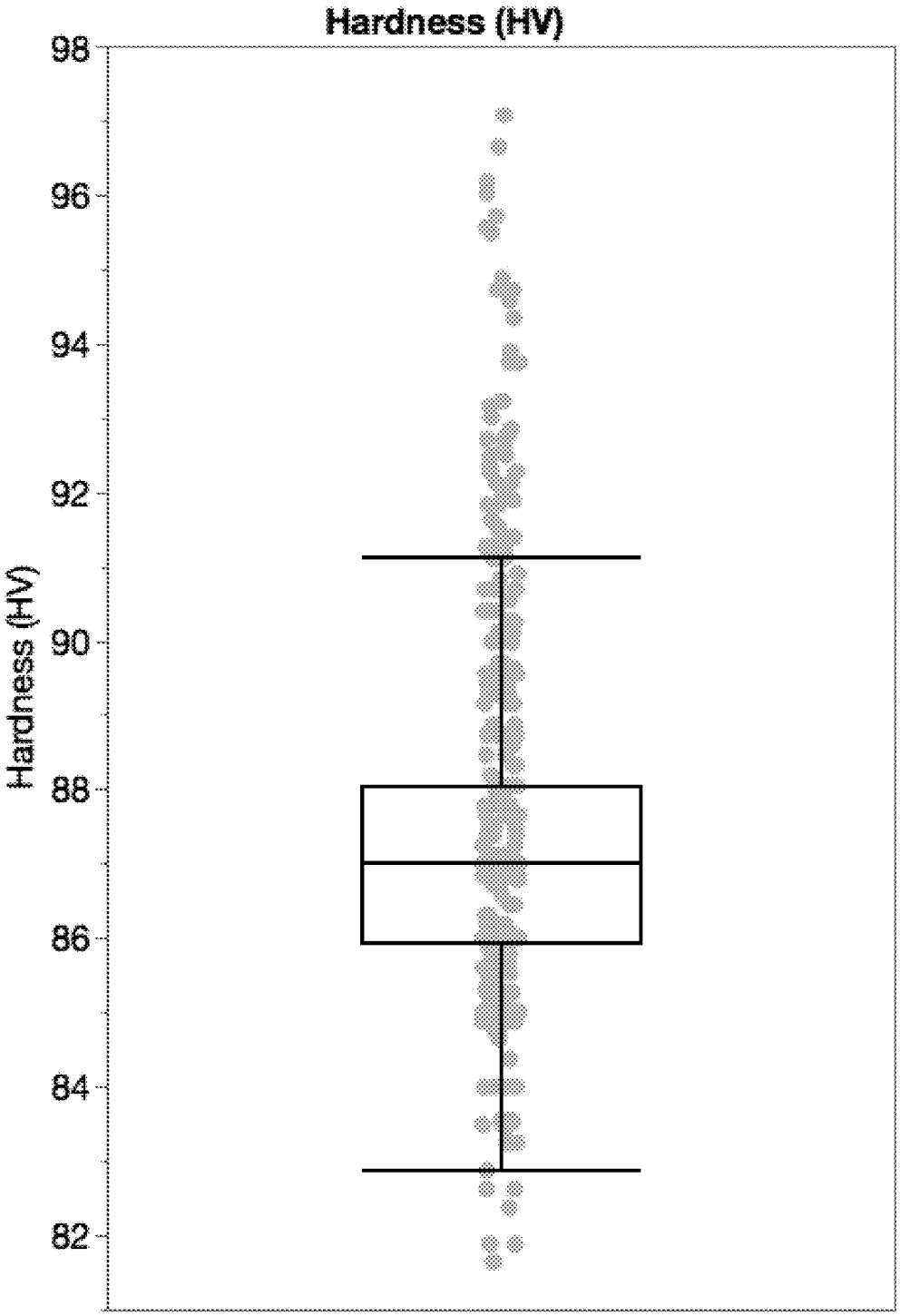
FIG. 6D illustrates the hardness for extrusion samples formed of an example of the disclosed recycled 6000 series aluminum alloys in accordance with embodiments of the disclosure.

FIG. 6D illustrates the hardness for extrusion samples formed of the recycled 6000 series aluminum alloy, in accordance with an embodiment of the disclosure.

Figure 7A:
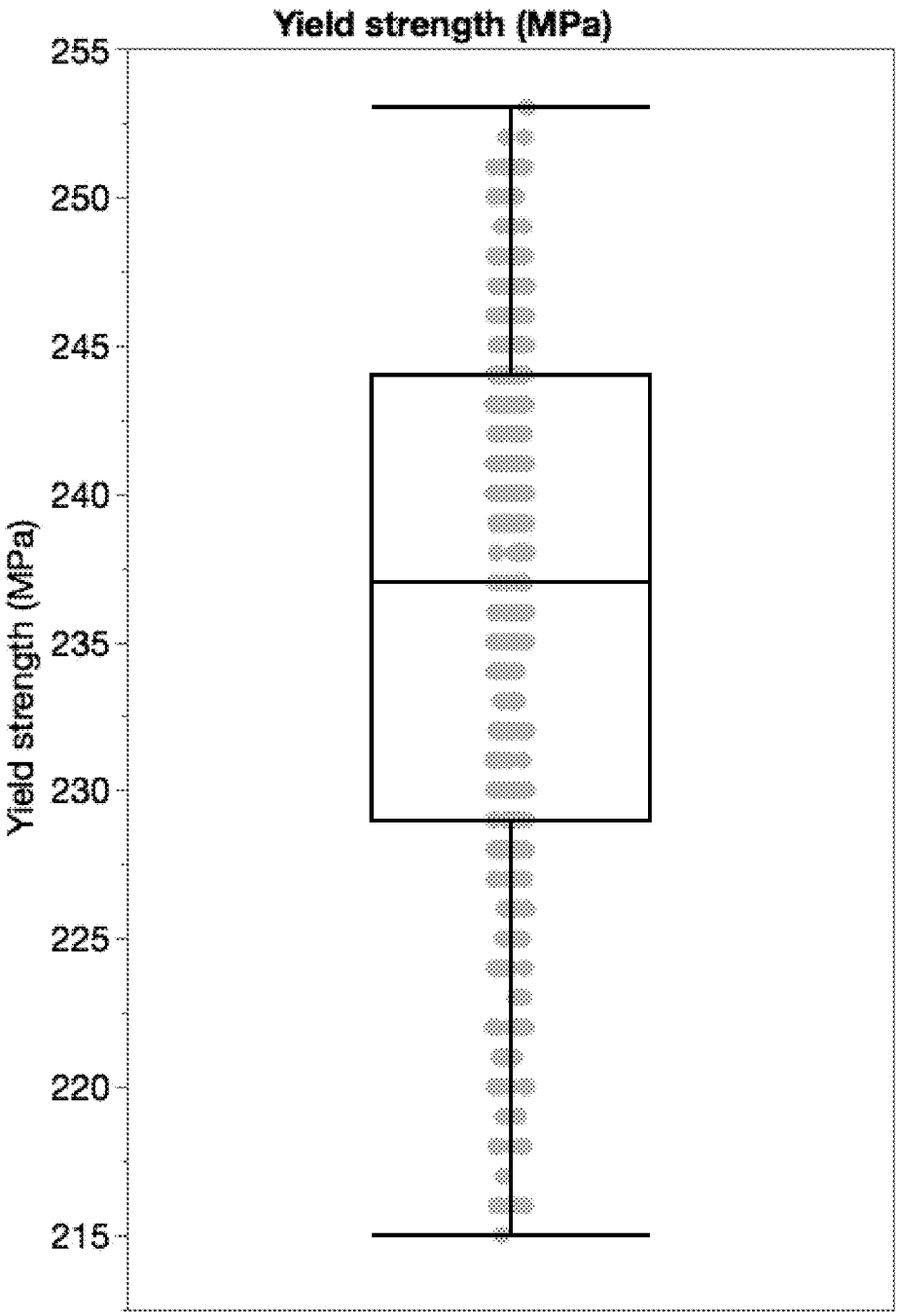
FIG. 7A illustrates the yield strength for sheet samples formed of an example of the disclosed recycled 6000 series aluminum alloys in accordance with embodiments of the disclosure.

FIG. 7A illustrates the yield strength for sheet samples formed of a sample recycled 6000 series aluminum alloy in accordance with embodiments of the disclosure.

Figure 7B:
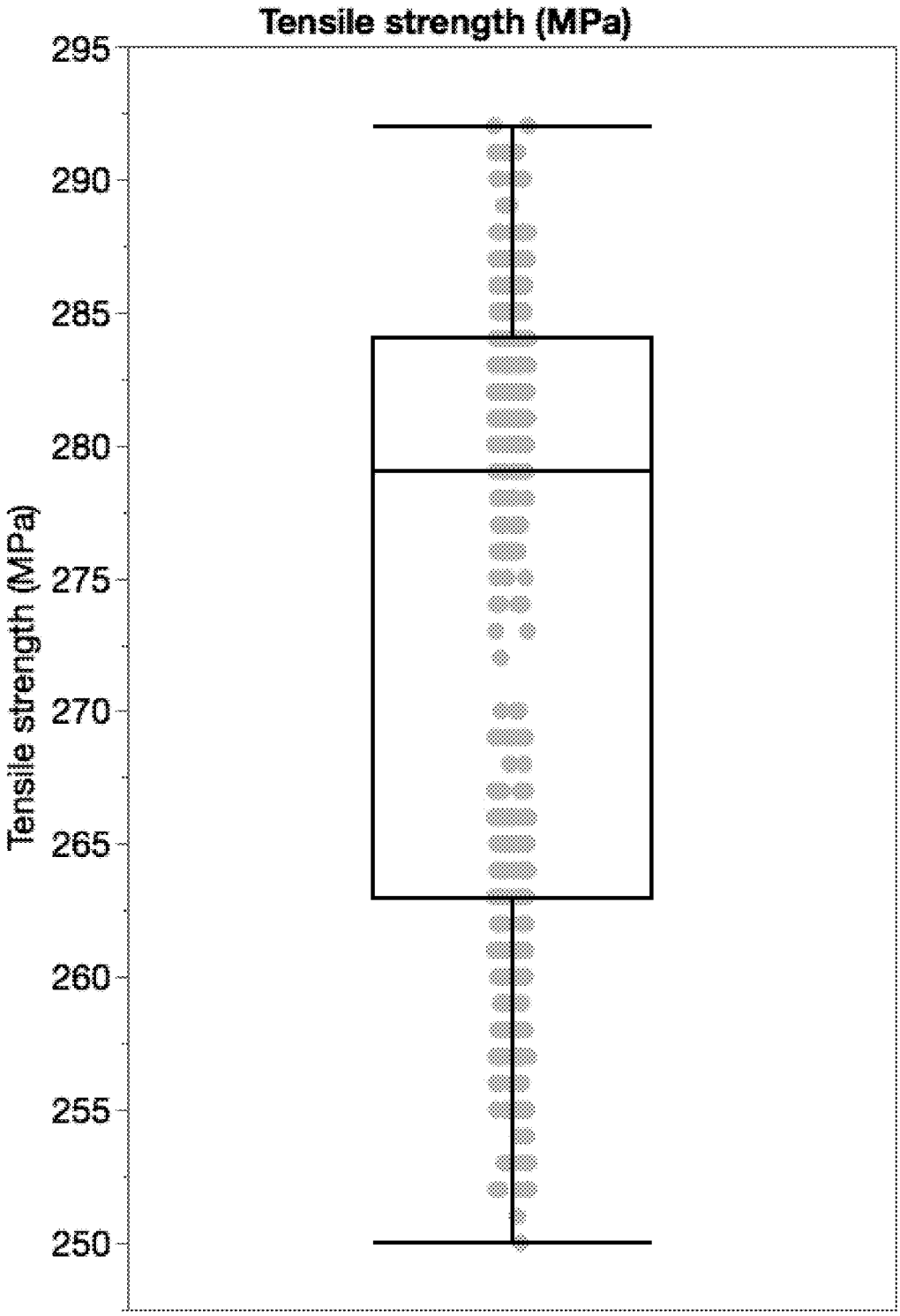
FIG. 7B illustrates the tensile strength for sheet samples formed of an example of the disclosed recycled 6000 series aluminum alloys in accordance with embodiments of the disclosure.

FIG. 7B illustrates the tensile strength for sheet samples formed of recycled 6000 series aluminum alloys, in accordance with an embodiments of the disclosure.

Figure 7C:
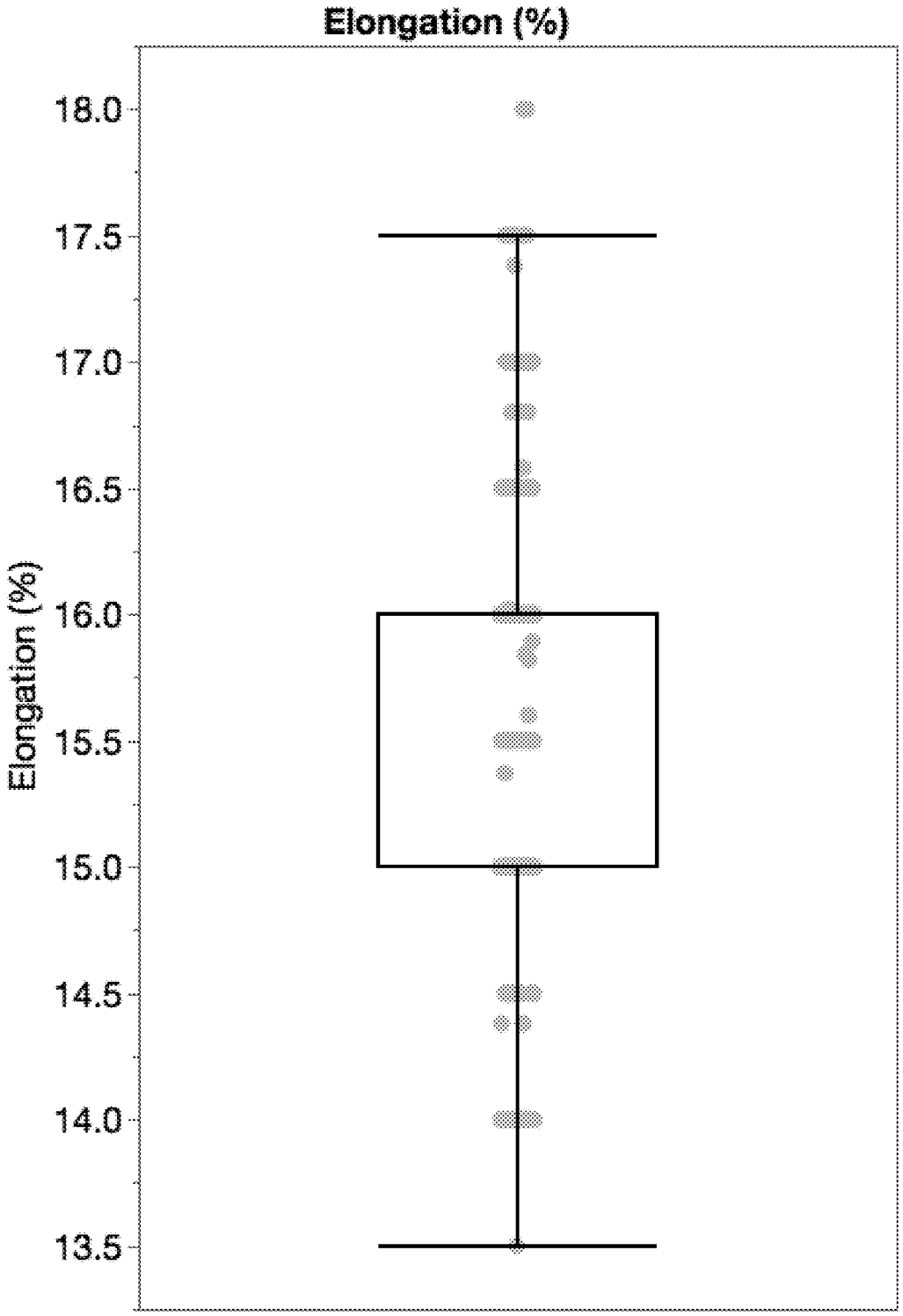
FIG. 7C illustrates the elongation for sheet samples formed of an example of the disclosed recycled 6000 series aluminum alloys in accordance with embodiments of the disclosure.

FIG. 7C illustrates the elongation for sheet samples formed of the recycled 6000 series aluminum alloy, in accordance with an embodiment of the disclosure. As shown in FIG. 7C, the recycled 6000 series aluminum alloy has an elongation with a 25% lower limit of about 15% to a 75% upper limit of about 16%. The example recycled 6000 series aluminum alloy also has a maximum elongation of 17.5% and a minimum elongation of 13.5%.

Figure 7D:
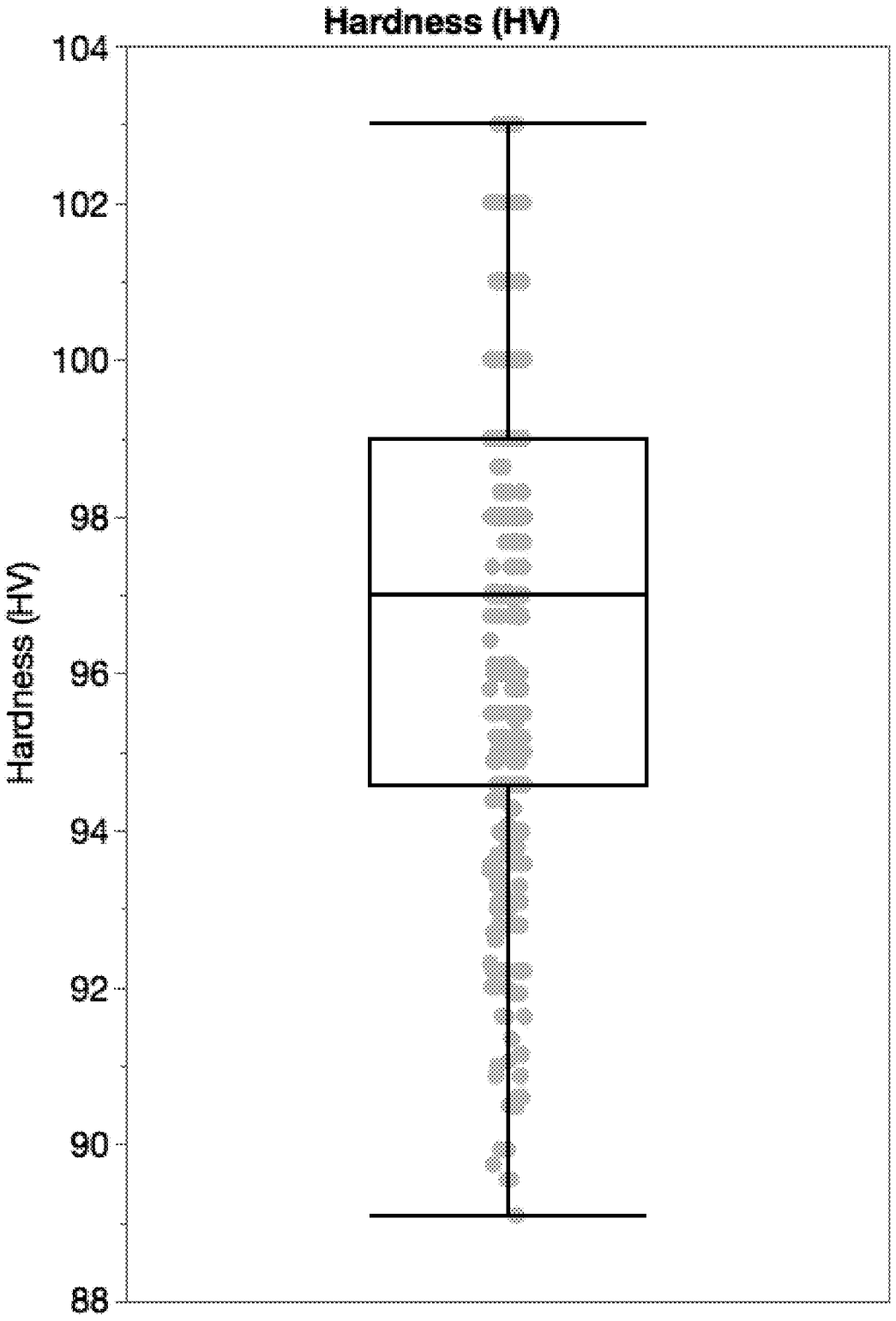
FIG. 7D illustrates the hardness for sheet samples formed of an example of the disclosed recycled 6000 series aluminum alloys in accordance with embodiments of the disclosure.

FIG. 7D illustrates the hardness for sheet samples formed of the recycled 6000 series aluminum alloy, in accordance with an embodiment of the disclosure.

Dimensional Consistency from Part to Part

The dimensional consistency from part to part is evaluated for recycled 6000 series aluminum alloys from three different manufacturing contractors A, B, and C. Results indicate that the dimensional consistency of the recycled 6000 series aluminum alloys all match or exceed the dimensional consistency of the primary or virgin aluminum alloys, regardless of the sources for the scrap.

Thermal Conductivity

The disclosed 6000 series aluminum alloys can also have a thermal conductivity of at least 175 W/mK, which helps heat dissipation of the electronic devices. In various embodiments, the thermal conductivity of the recycled alloys can be at least 150 W/mK. The thermal conductivity varies with alloy composition and thermal heat treatment. The thermal conductivity measured for the disclosed alloys range from 165 to 200 W/mK.

In various embodiments, the thermal conductivity of the recycled alloys can be equal to or greater than 165 W/mK. In various embodiments, the thermal conductivity of the recycled alloys can be equal to or greater than 175 W/mK. In various embodiments, the thermal conductivity of the recycled alloys can be equal to or greater than 185 W/mK. In various embodiments, the thermal conductivity of the recycled alloys can be equal to or greater than 195 W/m K.

In various embodiments, the thermal conductivity of the recycled alloys can be equal to and less than 200 W/mK. In various embodiments, the thermal conductivity of the recycled alloys can be equal to and less than 190 W/mK. In various embodiments, the thermal conductivity of the recycled alloys can be equal to and less than 180 W/mK. In various embodiments, the thermal conductivity of the recycled alloys can be equal to and less than 170 W/mK.

Microstructure

Microstructure can be characterized by average grain size, largest grain size, PCG layer depth, and grain aspect ratio.

Figure 8A:
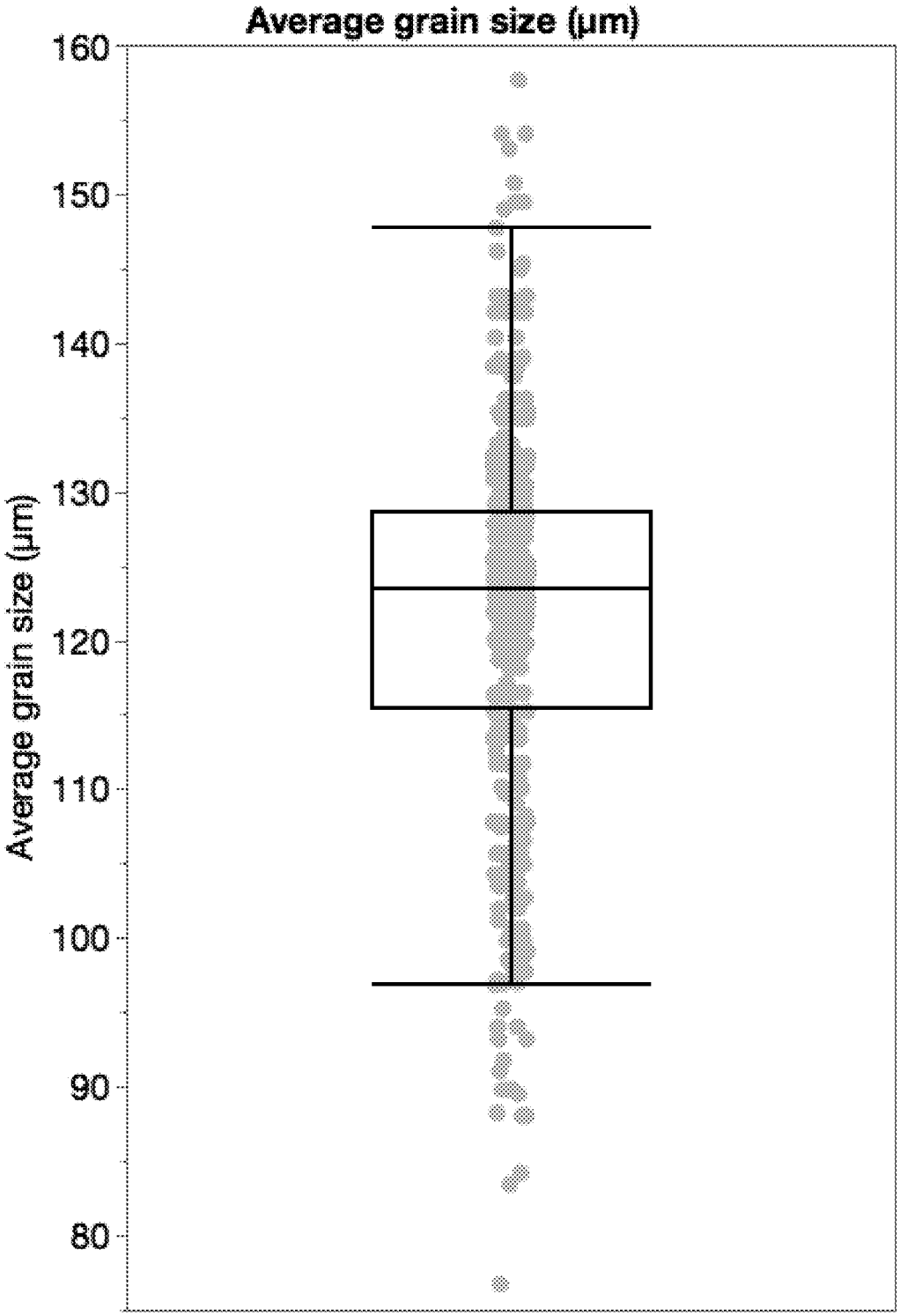
FIG. 8A illustrates the average grain size for extrusion samples formed of an example of the disclosed recycled 6000 series aluminum alloys in accordance with embodiments of the disclosure.
Figure 8B:
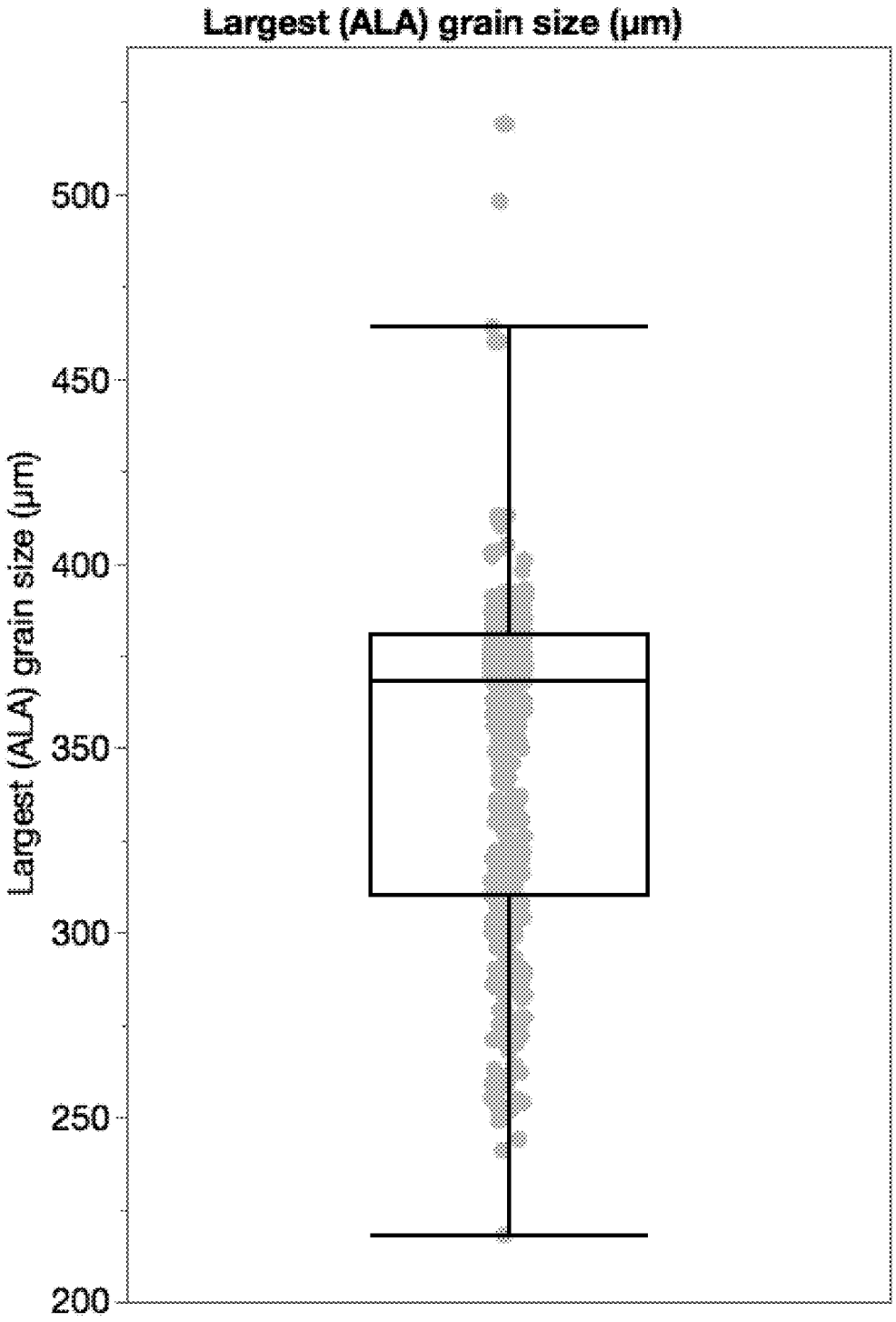
FIG. 8B illustrates the largest grain size for extrusion samples formed of an example of the disclosed recycled 6000 series aluminum alloys in accordance with embodiments of the disclosure.
Figure 8C:
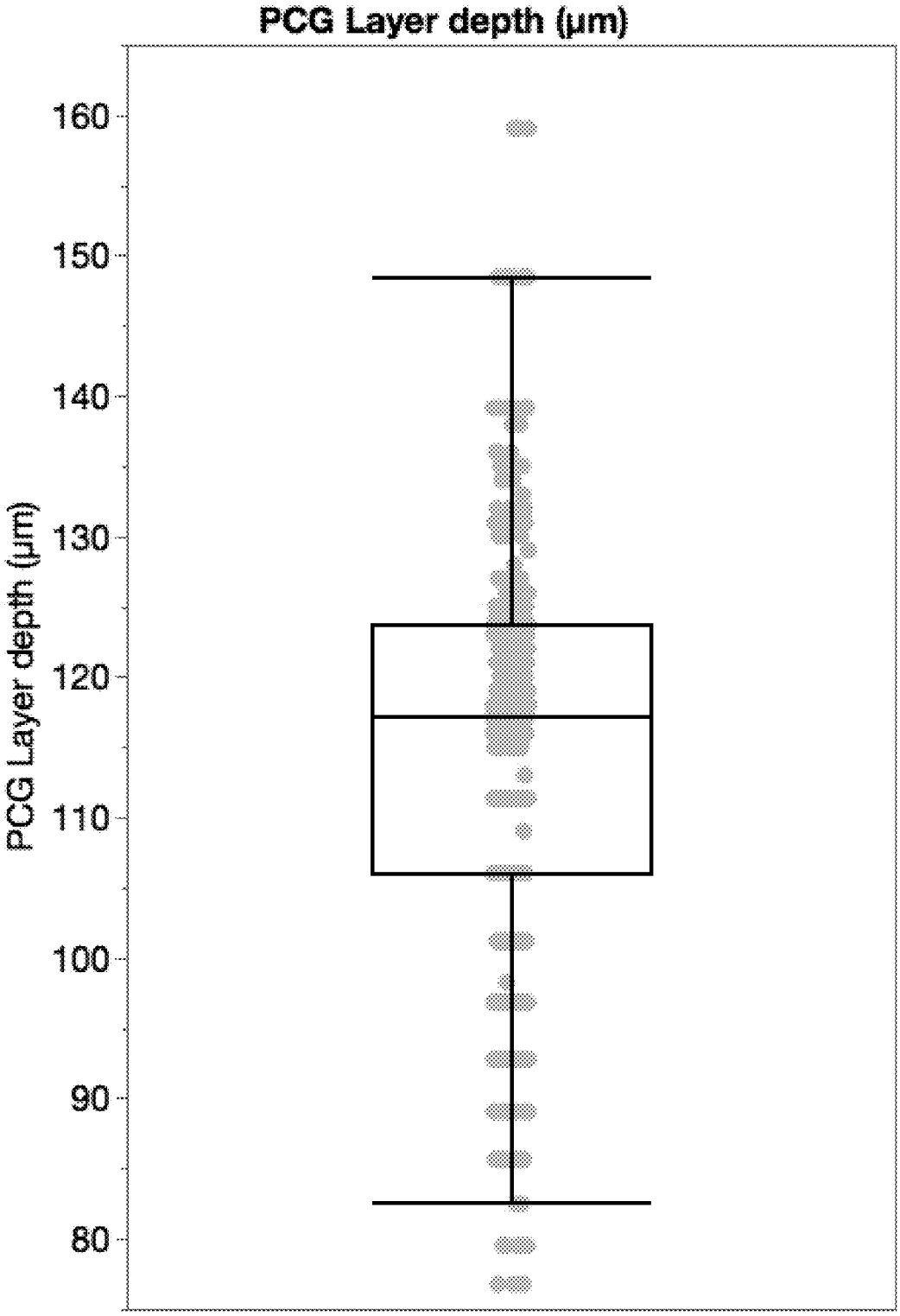
FIG. 8C illustrates the PCG layer depth for extrusion samples formed of an example of the disclosed recycled 6000 series aluminum alloys in accordance with embodiments of the disclosure.
Figure 8D:
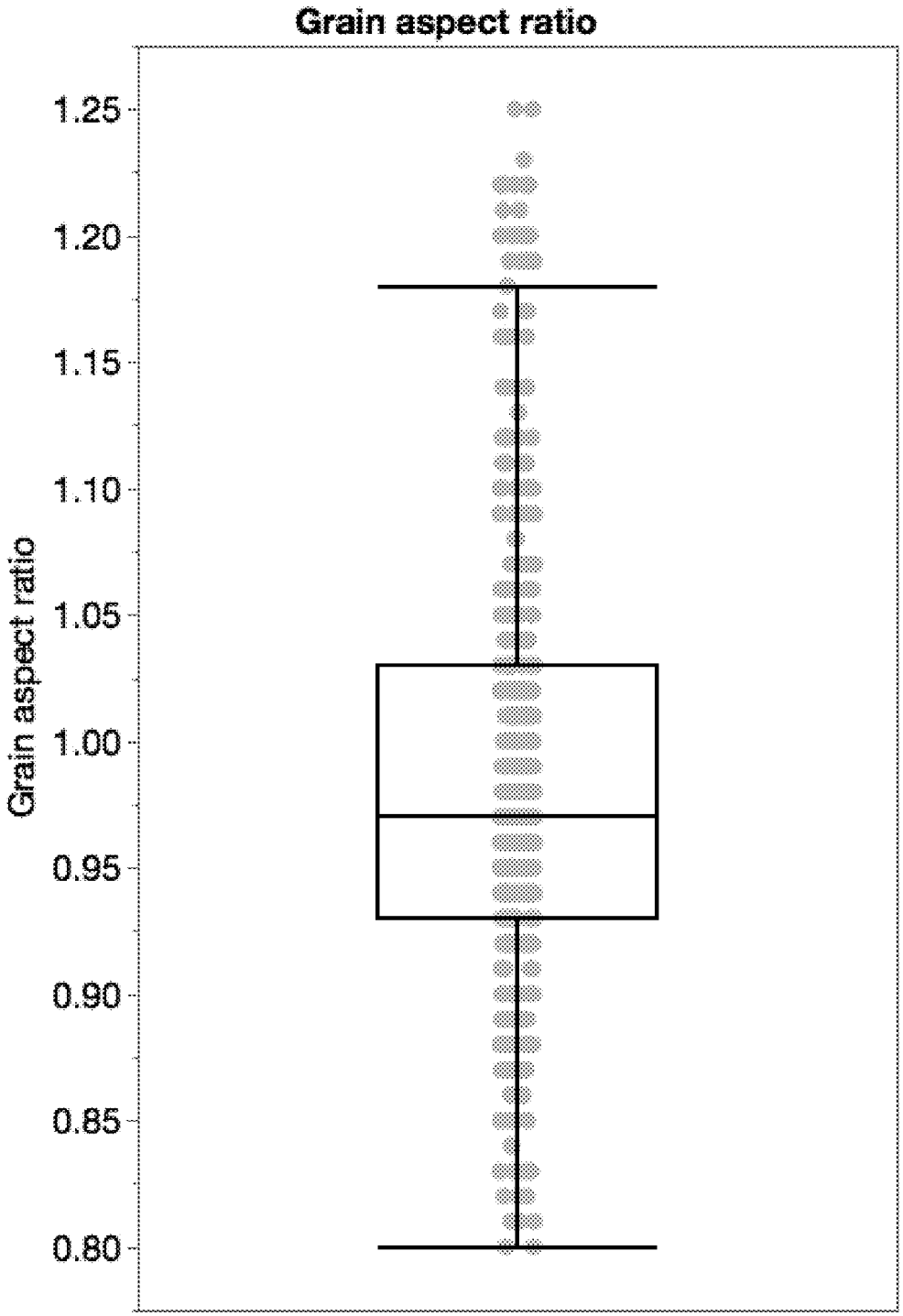
FIG. 8D illustrates the grain aspect ratio for extrusion samples formed of an example of the disclosed recycled 6000 series aluminum alloys in accordance with embodiments of the disclosure.
Figure 8E:
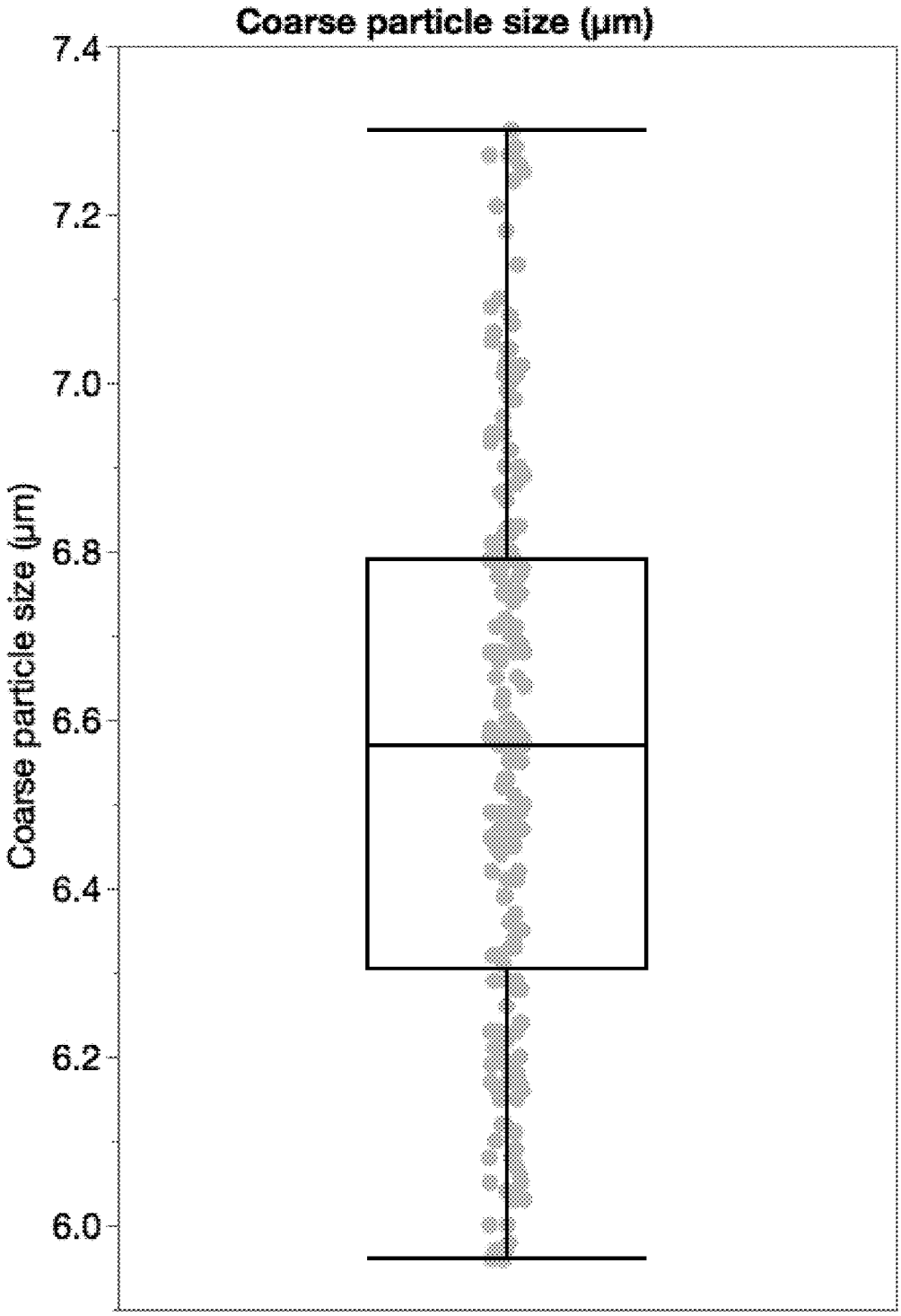
FIG. 8E illustrates the coarse particle sizes for extrusion samples formed of an example of the disclosed recycled 6000 series aluminum alloys in accordance with embodiments of the disclosure.

FIG. 8A illustrates the average grain size for extrusion samples formed of an example recycled 6000 series aluminum alloy. FIG. 8B illustrates the largest grain size for extrusion samples formed of an example recycled 6000 series aluminum alloy in accordance with an embodiment of the disclosure. FIG. 8C illustrates the PCG layer depth for extrusion samples formed of an example recycled 6000 series aluminum alloy in accordance with an embodiment of the disclosure. FIG. 8D illustrates the grain aspect ratio for extrusion samples formed of an example recycled 6000 series aluminum alloy in accordance with an embodiment of the disclosure. As shown in FIG. 8D, the aspect ratio of the grain is between a minimum value of 0.8 and a maximum value of 1.17 with a median value of 0.97. FIG. 8E illustrates the coarse particle sizes for extrusion samples formed of an example of the disclosed recycled 6000 series aluminum alloys in accordance with embodiments of the disclosure.

Figure 9A:
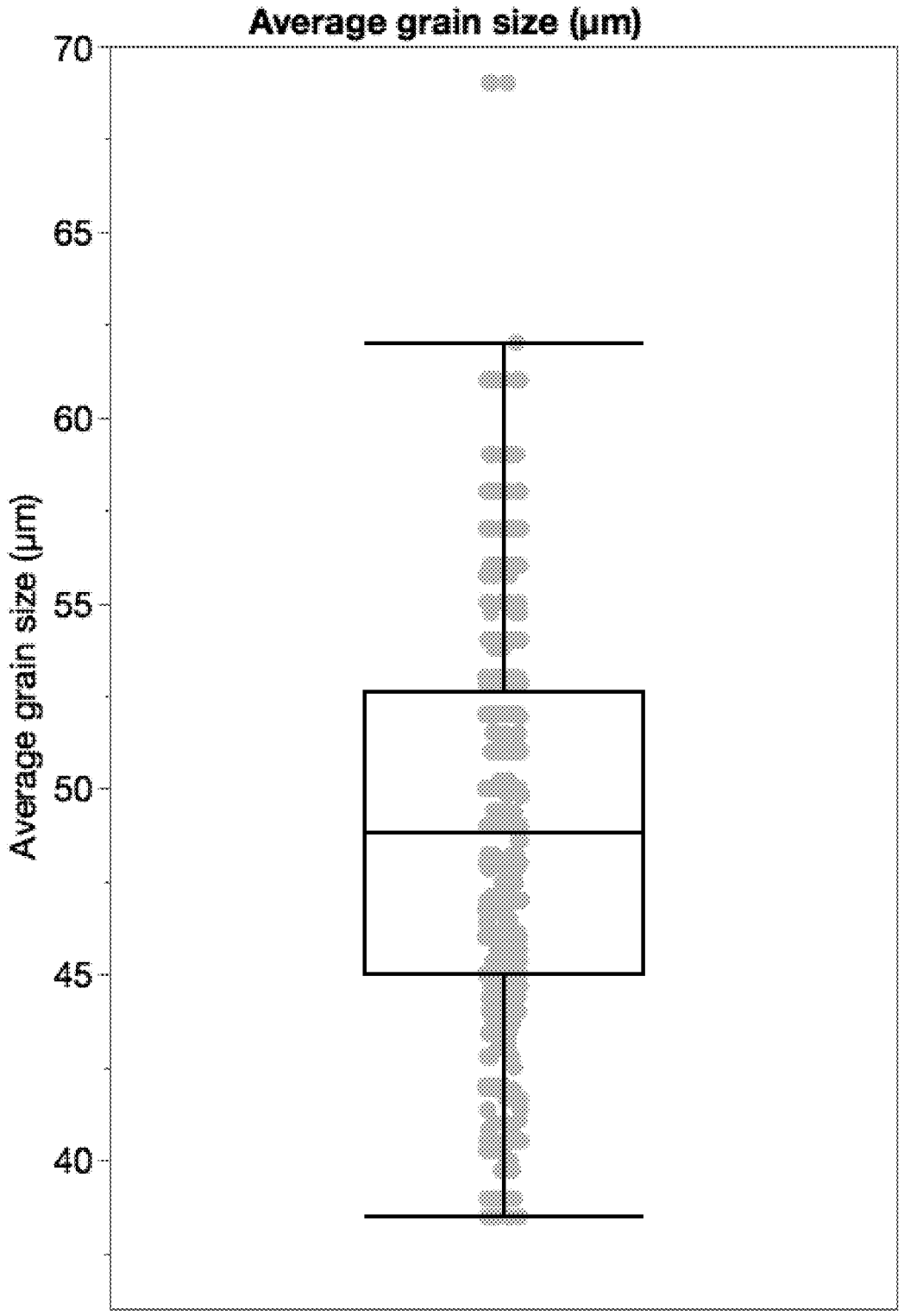
FIG. 9A illustrates the average grain size for sheet samples formed of an example of the disclosed recycled 6000 series aluminum alloys in accordance with embodiments of the disclosure.
Figure 9B:
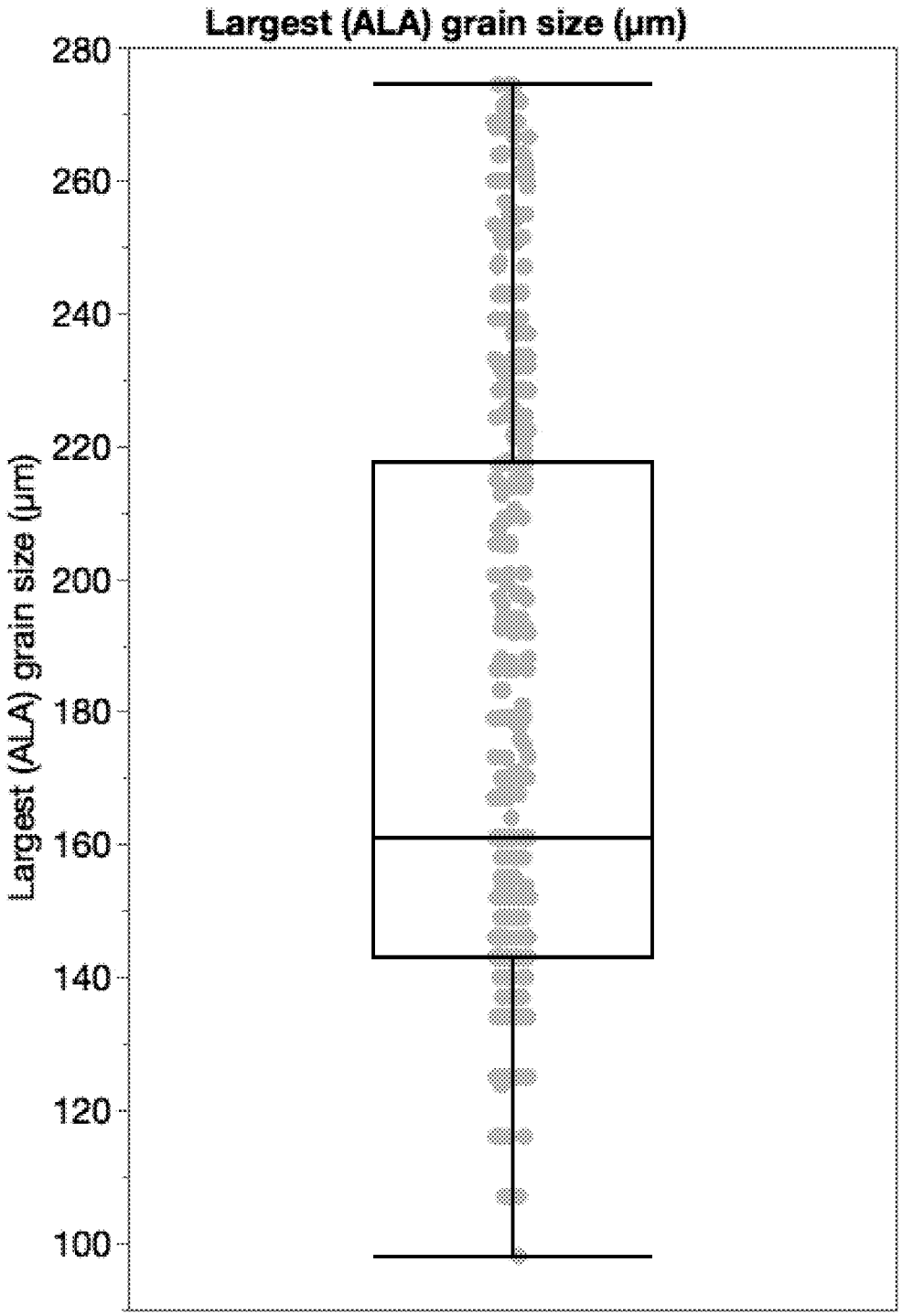
FIG. 9B illustrates the largest grain size for sheet samples formed of an example of the disclosed recycled 6000 series aluminum alloys in accordance with embodiments of the disclosure.
Figure 9C:
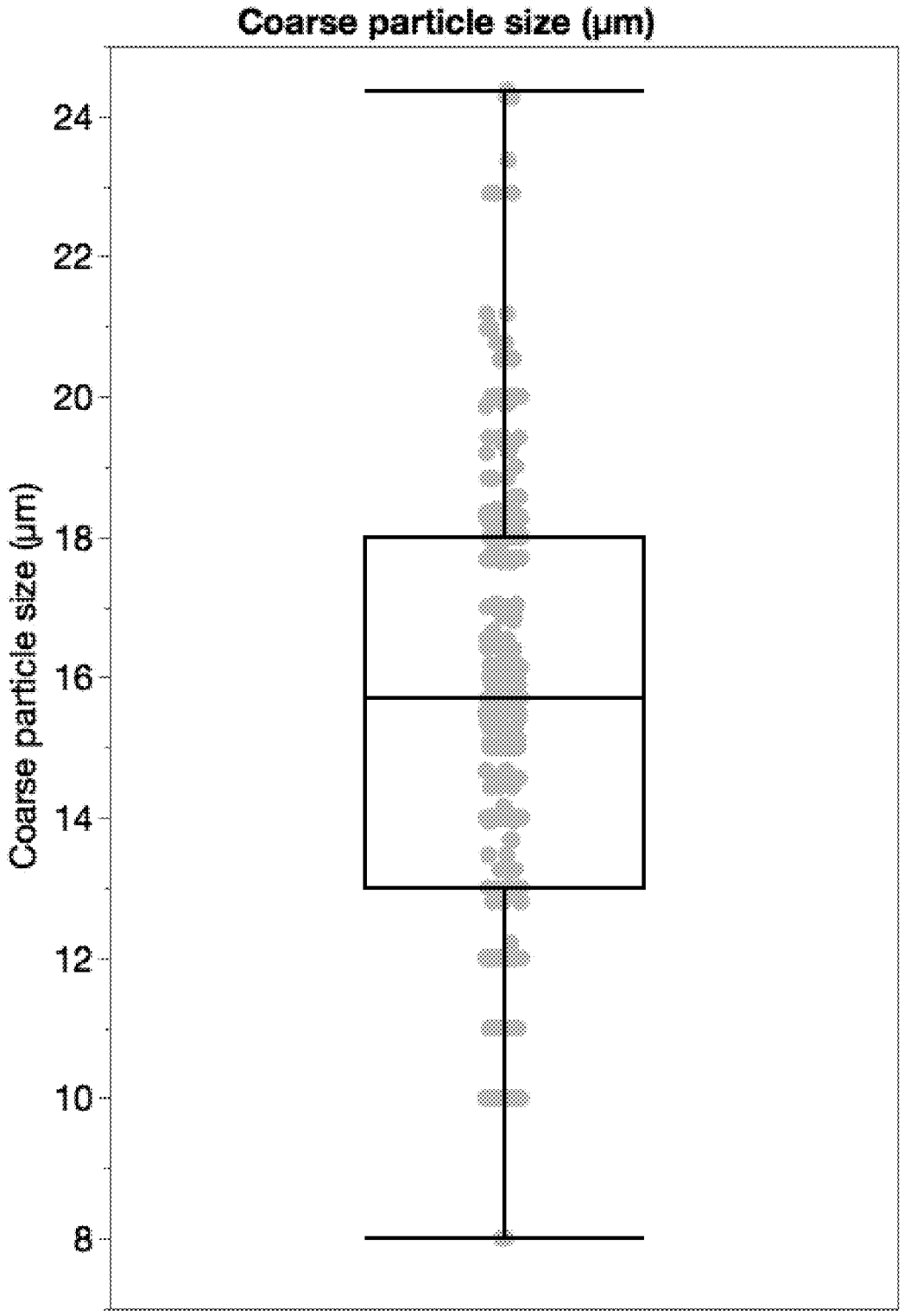
FIG. 9C illustrates the coarse particle sizes for sheet samples formed of an example of the disclosed recycled 6000 series aluminum alloys in accordance with embodiments of the disclosure.
Figure 9D:
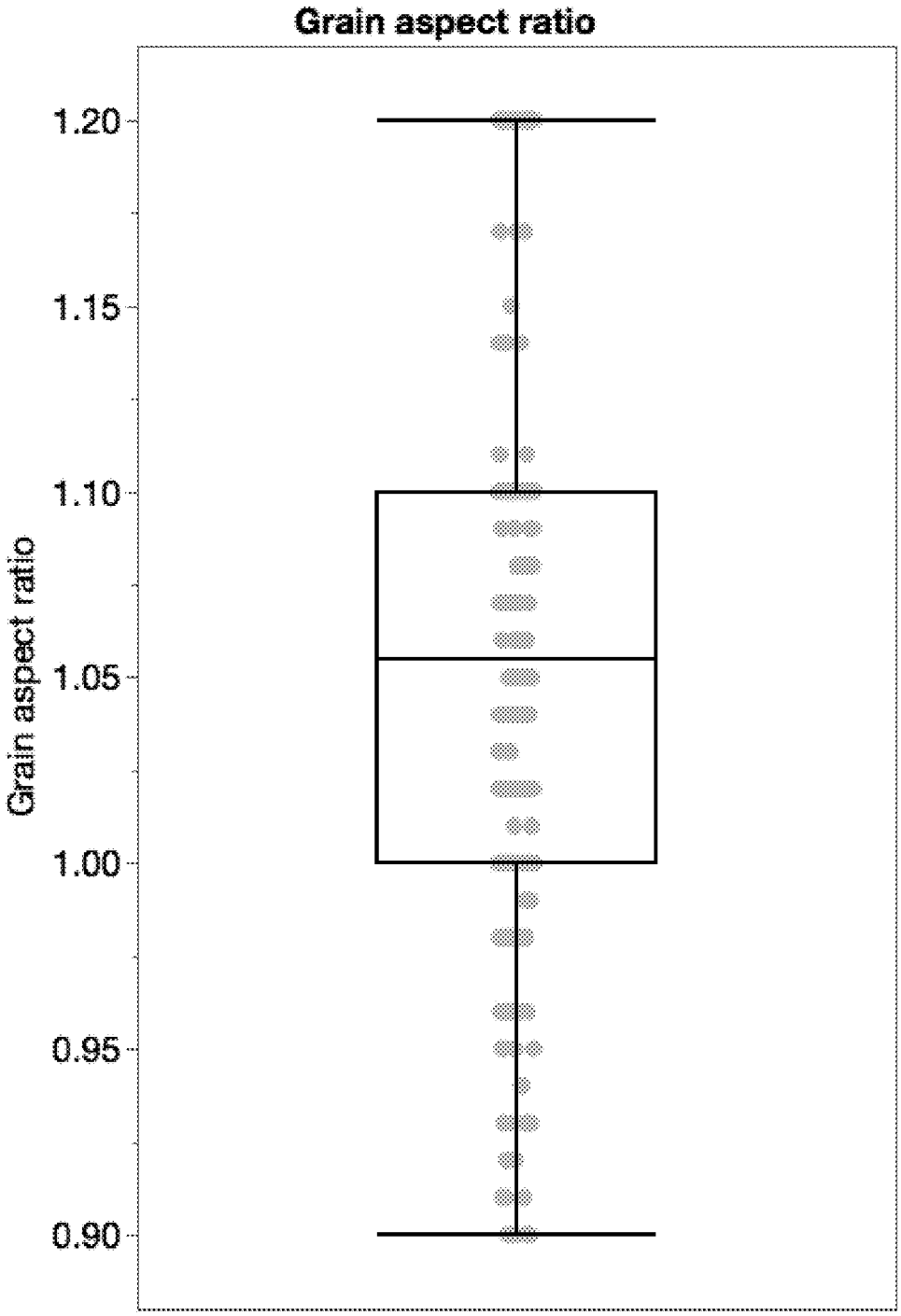
FIG. 9D illustrates the grain aspect ratio for sheet samples formed of an example of the disclosed recycled 6000 series aluminum alloys in accordance with embodiments of the disclosure.

FIG. 9A illustrates the average grain size for sheet samples formed of a recycled 6000 series aluminum alloy, in accordance with an embodiment of the disclosure. FIG. 9B illustrates the largest grain size for sheet samples formed of a recycled 6000 series aluminum alloy in accordance with embodiments of the disclosure. FIG. 9C illustrates the coarse particle sizes for sheet samples formed of a recycled 6000 series aluminum alloy in accordance with embodiments of the disclosure. FIG. 9D illustrates the grain aspect ratio for sheet samples formed of an example of the disclosed recycled 6000 series aluminum alloys in accordance with embodiments of the disclosure.

The disclosed aluminum alloys and methods can be used in the fabrication of electronic devices. An electronic device herein can refer to any electronic device known in the art. For example, such devices can include wearable devices such as a watch (e.g., an AppleWatch®). Devices can also be a telephone such a mobile phone (e.g., an iPhone®) a land-line phone, or any communication device (e.g., an electronic email sending/receiving device). The alloys can be a part of a display, such as a digital display, a TV monitor, an electronic-book reader, a portable web-browser (e.g., iPad®), and a computer monitor. The alloys can also be an entertainment device, including a portable DVD player, conventional DVD player, Blue-Ray disk player, video game console, music player, such as a portable music player (e.g., iPod®), etc. The alloys can also be a part of a device that provides control, such as controlling the streaming of images, videos, sounds (e.g., Apple TV®), or can be a remote control for an electronic device. The alloys can be a part of a computer or its accessories, such as the hard drive tower housing or casing for MacBookAir or Mac Mini.

Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the invention. Accordingly, the above description should not be taken as limiting the scope of the invention.

Those skilled in the art will appreciate that the disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the method and system, which, as a matter of language, might be said to fall therebetween.

What is claimed is:

1. An aluminum alloy comprising:

iron (Fe) in an amount of 0.10 wt % to 0.35 wt %;

silicon (Si) in an amount of 0.43 wt % to 0.80 wt %;

magnesium (Mg) in an amount of 0.45 wt % to 0.65 wt %;

manganese (Mn) in an amount 0.005 to 0.060 wt %;

copper (Cu) in an amount from 0.010 to 0.040 wt %;

additional non-aluminum (Al) elements in an amount not exceeding 3.0 wt %; and the remaining wt % being Al and incidental impurities, wherein the alloy is in the form of an extruded part and has an average grain size equal to or less than 160 μm.

2. The aluminum alloy of claim 1, wherein magnesium (Mg) is in an amount of at least 0.56 wt %.

3. The aluminum alloy of claim 1, further comprising titanium (Ti) from 0 to 0.10 wt %.

4. The aluminum alloy of claim 1, further comprising non-aluminum elements selected from:
chromium (Cr) from 0 to 0.10 wt %,
zinc (Zn) from 0 to 0.20 wt %,
gallium (Ga) from 0 to 0.20 wt %,
tin (Sn) from 0 to 0.20 wt %,
vanadium (V) from 0 to 0.20 wt %,
calcium (Ca) from 0 to 0.001 wt %,
sodium (Na) from 0 to 0.002 wt %,
boron (B) from 0 to 0.01 wt %,
zirconium (Zr) from 0 to 0.01 wt %,
lithium (Li) from 0 to 0.01 wt %,
cadmium (Cd) from 0 to 0.01 wt %,
lead (Pb) from 0 to 0.01 wt %,
nickel (Ni) from 0 to 0.01 wt %,
phosphorous (P) from 0 to 0.01 wt %, and
combinations thereof.

5. The aluminum alloy of claim 1, wherein copper (Cu) in an amount from 0.010 to 0.020 wt %.

6. The aluminum alloy of claim 1, wherein the aluminum alloy has a yield strength of at least 205 MPa and a tensile strength of at least 240 MPa.

7. A process for recycling manufacturing scrap, the process comprising:
(a) obtaining a first recycled aluminum alloy from a first source and a second recycled aluminum alloy from a second source;
(b) melting the first and second recycled aluminum alloys to form a melted recycled 6000 series aluminum alloy;
(c) casting the melted recycled 6000 series aluminum alloy to form a casted alloy;
(d) extruding the casted alloy to form an extrusion; and
(e) fabricating the extrusion to produce the aluminum alloy of claim 1.

8. The process of claim 7, wherein the step of melting comprises removing oxides from the first and second recycled aluminum alloys.

9. An aluminum alloy comprising:
iron (Fe) in an amount of 0.10 wt % to 0.35 wt %;
silicon (Si) in an amount of 0.43 wt % to 0.80 wt %;
magnesium (Mg) in an amount of 0.45 wt % to 0.65 wt %;
manganese (Mn) in an amount 0.005 to 0.060 wt %;
copper (Cu) in an amount from 0.010 to 0.040 wt %;
additional non-aluminum (Al) elements in an amount not exceeding 3.0 wt %; and
the remaining wt % being Al and incidental impurities,
wherein the alloy is in the form of a sheet and has an average grain size equal to or less than 100 μm.

10. The aluminum alloy of claim 9, wherein
magnesium (Mg) is in an amount of at least 0.56 wt %.

11. The aluminum alloy of claim 9, further comprising titanium (Ti) from 0 to 0.10 wt %.

12. The aluminum alloy of claim 9, further comprising non-aluminum elements selected from:
chromium (Cr) from 0 to 0.10 wt %,
zinc (Zn) from 0 to 0.20 wt %,
gallium (Ga) from 0 to 0.20 wt %,
tin (Sn) from 0 to 0.20 wt %,
vanadium (V) from 0 to 0.20 wt %,
calcium (Ca) from 0 to 0.001 wt %,
sodium (Na) from 0 to 0.002 wt %,
boron (B) from 0 to 0.01 wt %,
zirconium (Zr) from 0 to 0.01 wt %,
lithium (Li) from 0 to 0.01 wt %,
cadmium (Cd) from 0 to 0.01 wt %,
lead (Pb) from 0 to 0.01 wt %,
nickel (Ni) from 0 to 0.01 wt %,
phosphorous (P) from 0 to 0.01 wt %, and
combinations thereof.

13. The aluminum alloy of claim 9, wherein copper (Cu) in an amount from 0.010 to 0.020 wt %.

14. The aluminum alloy of claim 9, wherein the recycled 6000 series aluminum alloy has a yield strength of 210 MPa and a tensile strength of 230 MPa after sheet rolling.

15. A process for recycling manufacturing scrap, the process comprising:
(a) obtaining a first recycled aluminum alloy from a first source and a second recycled aluminum alloy from a second source;
(b) melting the first and second recycled aluminum alloys to form a melted recycled 6000 series aluminum alloy;
(c) casting the melted recycled 6000 series aluminum alloy to form a casted alloy;
(d) rolling the casted alloy to form a sheet; and
(e) fabricating the sheet to produce the aluminum alloy of claim 9.

16. The process of claim 15, wherein the step of melting comprises removing oxides from the first and second recycled aluminum alloys.

17. An aluminum alloy comprising:
iron (Fe) in an amount of 0.10 wt % to 0.35 wt %;
silicon (Si) in an amount of 0.43 wt % to 0.80 wt %;
magnesium (Mg) in an amount of 0.45 wt % to 0.65 wt %;
manganese (Mn) in an amount 0.005 to 0.060 wt %;
copper (Cu) in an amount from 0.010 to 0.040 wt %;
additional non-aluminum (Al) elements in an amount not exceeding 3.0 wt %; and
the remaining wt % being Al and incidental impurities,
wherein the alloy is in the form of an extruded part and has a yield strength of at least 205 MPa and a tensile strength of at least 240 MPa.

18. The aluminum alloy of claim 17, wherein
magnesium (Mg) is in an amount of at least 0.56 wt %.

19. The aluminum alloy of claim 17, further comprising titanium (Ti) from 0 to 0.10 wt %.

20. The aluminum alloy of claim 17, further comprising non-aluminum elements selected from:
chromium (Cr) from 0 to 0.10 wt %,
zinc (Zn) from 0 to 0.20 wt %,
gallium (Ga) from 0 to 0.20 wt %,
tin (Sn) from 0 to 0.20 wt %,
vanadium (V) from 0 to 0.20 wt %,
calcium (Ca) from 0 to 0.001 wt %,
sodium (Na) from 0 to 0.002 wt %,
boron (B) from 0 to 0.01 wt %,
zirconium (Zr) from 0 to 0.01 wt %,
lithium (Li) from 0 to 0.01 wt %,
cadmium (Cd) from 0 to 0.01 wt %,
lead (Pb) from 0 to 0.01 wt %,
nickel (Ni) from 0 to 0.01 wt %,
phosphorous (P) from 0 to 0.01 wt %, and
combinations thereof.

21. The aluminum alloy of claim 17, wherein copper (Cu) in an amount from 0.010 to 0.020 wt %.

22. A process for recycling manufacturing scrap, the process comprising:
(a) obtaining a first recycled aluminum alloy from a first source and a second recycled aluminum alloy from a second source;
(b) melting the first and second recycled aluminum alloys to form a melted recycled 6000 series aluminum alloy;
(c) casting the melted recycled 6000 series aluminum alloy to form a casted alloy;
(d) extruding the casted alloy to form an extrusion; and (e) fabricating the extrusion to produce the aluminum alloy of claim 17.

23. The process of claim 22, wherein the step of melting comprises removing oxides from the first and second recycled aluminum alloys.

24. An aluminum alloy comprising:
iron (Fe) in an amount of 0.10 wt % to 0.35 wt %;
silicon (Si) in an amount of 0.43 wt % to 0.80 wt %;
magnesium (Mg) in an amount of 0.45 wt % to 0.65 wt %;
manganese (Mn) in an amount 0.005 to 0.060 wt %;
copper (Cu) in an amount from 0.010 to 0.040 wt %;
additional non-aluminum (Al) elements in an amount not exceeding 3.0 wt %; and
the remaining wt % being Al and incidental impurities, wherein the alloy is in the form of a sheet and has a yield strength of at least 210 MPa and a tensile strength of at least 230 MPa.

25. The aluminum alloy of claim 24, wherein
magnesium (Mg) is in an amount of at least 0.56 wt %.

26. The aluminum alloy of claim 24, further comprising titanium (Ti) from 0 to 0.10 wt %.

27. The aluminum alloy of claim 24, further comprising non-aluminum elements selected from:
chromium (Cr) from 0 to 0.10 wt %,
zinc (Zn) from 0 to 0.20 wt %,
gallium (Ga) from 0 to 0.20 wt %,
tin (Sn) from 0 to 0.20 wt %,
vanadium (V) from 0 to 0.20 wt %,
calcium (Ca) from 0 to 0.001 wt %,
sodium (Na) from 0 to 0.002 wt %,
boron (B) from 0 to 0.01 wt %,
zirconium (Zr) from 0 to 0.01 wt %,
lithium (Li) from 0 to 0.01 wt %,
cadmium (Cd) from 0 to 0.01 wt %,
lead (Pb) from 0 to 0.01 wt %,
nickel (Ni) from 0 to 0.01 wt %,
phosphorous (P) from 0 to 0.01 wt %, and
combinations thereof.

28. The aluminum alloy of claim 24, wherein copper (Cu) in an amount from 0.010 to 0.020 wt %.

29. A process for recycling manufacturing scrap, the process comprising:
(a) obtaining a first recycled aluminum alloy from a first source and a second recycled aluminum alloy from a second source;
(b) melting the first and second recycled aluminum alloys to form a melted recycled 6000 series aluminum alloy;
(c) casting the melted recycled 6000 series aluminum alloy to form a casted alloy;
(d) rolling the casted alloy to form a sheet; and
(e) fabricating the sheet to produce the aluminum alloy of claim 24.

30. The process of claim 29, wherein the step of melting comprises removing oxides from the first and second recycled aluminum alloys.

31. An aluminum alloy comprising:
iron (Fe) in an amount of 0.10 wt % to 0.35 wt %;
silicon (Si) in an amount of 0.43 wt % to 0.80 wt %;
magnesium (Mg) in an amount of 0.45 wt % to 0.65 wt %;
manganese (Mn) in an amount 0.005 to 0.060 wt %;
copper (Cu) in an amount from 0.010 to 0.040 wt %;
additional non-aluminum (Al) elements in an amount not exceeding 3.0 wt %; and
the remaining wt % being Al and incidental impurities, wherein the alloy is in the form of an extruded part and has a hardness of at least 80 Vickers.

32. The alloy of claim 31, wherein
magnesium (Mg) is in an amount of at least 0.56 wt %.

33. The alloy of claim 31, further comprising titanium (Ti) from 0 to 0.10 wt %.

34. The aluminum alloy of claim 31, further comprising non-aluminum elements selected from:
chromium (Cr) from 0 to 0.10 wt %,
zinc (Zn) from 0 to 0.20 wt %,
gallium (Ga) from 0 to 0.20 wt %,
tin (Sn) from 0 to 0.20 wt %,
vanadium (V) from 0 to 0.20 wt %,
calcium (Ca) from 0 to 0.001 wt %,
sodium (Na) from 0 to 0.002 wt %,
boron (B) from 0 to 0.01 wt %,
zirconium (Zr) from 0 to 0.01 wt %,
lithium (Li) from 0 to 0.01 wt %,
cadmium (Cd) from 0 to 0.01 wt %,
lead (Pb) from 0 to 0.01 wt %,
nickel (Ni) from 0 to 0.01 wt %,
phosphorous (P) from 0 to 0.01 wt %, and
combinations thereof.

35. The aluminum alloy of claim 31, wherein copper (Cu) in an amount from 0.010 to 0.020 wt %.

36. A process for recycling manufacturing scrap, the process comprising:
(a) obtaining a first recycled aluminum alloy from a first source and a second recycled aluminum alloy from a second source;
(b) melting the first and second recycled aluminum alloys to form a melted recycled 6000 series aluminum alloy;
(c) casting the melted recycled 6000 series aluminum alloy to form a casted alloy;
(d) extruding the casted alloy to form an extrusion; and
(e) fabricating the extrusion to produce the aluminum alloy of claim 31.

37. The process of claim 36, wherein the step of melting comprises removing oxides from the first and second recycled aluminum alloys.

38. An aluminum alloy comprising:
iron (Fe) in an amount of 0.10 wt % to 0.35 wt %;
silicon (Si) in an amount of 0.43 wt % to 0.80 wt %;
magnesium (Mg) in an amount of 0.45 wt % to 0.65 wt %;
manganese (Mn) in an amount 0.005 to 0.060 wt %;
copper (Cu) in an amount from 0.010 to 0.040 wt %;
additional non-aluminum (Al) elements in an amount not exceeding 3.0 wt %; and
the remaining wt % being Al and incidental impurities, wherein the alloy is in the form of a sheet and has a hardness of at least 75 Vickers.

39. The aluminum alloy of claim 38, wherein
magnesium (Mg) is in an amount of at least 0.56 wt %.

40. The aluminum alloy of claim 38, further comprising titanium (Ti) from 0 to 0.10 wt %.

41. The aluminum alloy of claim 38, further comprising non-aluminum elements selected from:
chromium (Cr) from 0 to 0.10 wt %,
zinc (Zn) from 0 to 0.20 wt %,
gallium (Ga) from 0 to 0.20 wt %,
tin (Sn) from 0 to 0.20 wt %,
vanadium (V) from 0 to 0.20 wt %,
calcium (Ca) from 0 to 0.001 wt %,
sodium (Na) from 0 to 0.002 wt %,
boron (B) from 0 to 0.01 wt %,
zirconium (Zr) from 0 to 0.01 wt %,
lithium (Li) from 0 to 0.01 wt %,
cadmium (Cd) from 0 to 0.01 wt %,
lead (Pb) from 0 to 0.01 wt %,
nickel (Ni) from 0 to 0.01 wt %, phosphorous (P) from 0 to 0.01 wt %, and combinations thereof.

42. The aluminum alloy of claim 38, wherein copper (Cu) in an amount from 0.010 to 0.020 wt %.

43. A process for recycling manufacturing scrap, the process comprising:

(a) obtaining a first recycled aluminum alloy from a first source and a second recycled aluminum alloy from a second source;

(b) melting the first and second recycled aluminum alloys to form a melted recycled 6000 series aluminum alloy;

(c) casting the melted recycled 6000 series aluminum alloy to form a casted alloy;

(d) rolling the casted alloy to form a sheet; and (e) fabricating the sheet to produce the aluminum alloy of claim 38.

44. The process of claim 43, wherein the step of melting comprises removing oxides from the first and second recycled aluminum alloys.

* * * * *